US009101521B2

(12) United States Patent
White et al.

(10) Patent No.: US 9,101,521 B2
(45) Date of Patent: Aug. 11, 2015

(54) SYSTEMS, METHODS AND TRANSFER SHEETS FOR TRANSFERRING PATIENTS

(71) Applicant: CEGA Innovations, LLC, Sioux Falls, SD (US)

(72) Inventors: Ty A. White, Sioux Falls, SD (US); Aaron J. Emerson, Sioux Falls, SD (US)

(73) Assignee: CEGA INNOVATIONS, LLC, Sioux Falls, SD (US)

( * ) Notice: Subject to any disclaimer, the term of this patent is extended or adjusted under 35 U.S.C. 154(b) by 0 days.

(21) Appl. No.: 14/153,805

(22) Filed: Jan. 13, 2014

(65) Prior Publication Data

US 2014/0123384 A1 May 8, 2014

Related U.S. Application Data

(63) Continuation-in-part of application No. 13/626,457, filed on Sep. 25, 2012, now Pat. No. 8,782,826.

(60) Provisional application No. 61/624,527, filed on Apr. 16, 2012.

(51) Int. Cl.

| | |
|---|---|
| ***A61G 1/003*** | (2006.01) |
| ***A61G 7/00*** | (2006.01) |
| ***A61G 7/10*** | (2006.01) |

(52) U.S. Cl.

CPC ..... *A61G 7/1032* (2013.01); *A61G 7/1026* (2013.01); *A61G 2203/76* (2013.01); *Y10T 156/10* (2015.01)

(58) Field of Classification Search

CPC ..... A61G 2200/32; A61G 7/1026; A61G 7/1032; A61G 7/103; A61G 7/1034

See application file for complete search history.

(56) References Cited

U.S. PATENT DOCUMENTS

| | | | |
|---|---|---|---|
| 1,829,274 | A | 10/1931 | Gilroy |
| 2,630,583 | A | 3/1953 | Gilleland |
| 2,665,432 | A | 1/1954 | Butler |
| 3,115,646 | A | 12/1963 | Lee |
| 3,593,351 | A | 7/1971 | Dove |
| 3,854,152 | A | 12/1974 | Chez |

(Continued)

FOREIGN PATENT DOCUMENTS

SU 1090388 A1 5/1984

OTHER PUBLICATIONS

"The Sahara Super Absorbent O.R. Table Sheet," Featured in QuickSuite O.R. Clean-up Kits. Medline Canada, 2008, 6 pgs.

(Continued)

*Primary Examiner* — Timothy D Collins
*Assistant Examiner* — Richard G Davis
(74) *Attorney, Agent, or Firm* — Dorsey & Whitney LLP

(57) ABSTRACT

A transfer sheet comprises a substantially impervious structural base layer, an absorbent layer disposed on the base layer, and a permeable layer disposed on the absorbent layer, with the absorbent layer between the base and permeable layers. An adhesive area can be provided on the bottom of the base layer, opposite the absorbent and permeable layers, with a removable tab extending over the adhesive. The adhesive can be configured for attaching the base layer to the continuous belt of a patient transfer device, where the continuous belt is disposed about a bridge spaced between two sides of a housing, for use in conveying a patient or other body from one surface to another.

35 Claims, 29 Drawing Sheets

(56) References Cited

U.S. PATENT DOCUMENTS

| | | | | |
|---|---|---|---|---|
| 3,871,036 | A | | 3/1975 | Attenburrow |
| 3,947,902 | A | | 4/1976 | Conde et al. |
| 3,967,328 | A | | 7/1976 | Cox |
| 4,073,016 | A | | 2/1978 | Koll |
| 4,077,073 | A | | 3/1978 | Koll et al. |
| 4,077,410 | A | * | 3/1978 | Butterworth et al. ..... 604/366 |
| 4,097,943 | A | * | 7/1978 | O'Connell ..... 5/484 |
| 4,222,132 | A | | 9/1980 | Crim et al. |
| 4,813,088 | A | | 3/1989 | DiMatteo et al. |
| 5,048,133 | A | | 9/1991 | Iura et al. |
| 5,152,016 | A | | 10/1992 | Becker |
| 5,271,110 | A | | 12/1993 | Newman |
| RE35,468 | E | | 3/1997 | Newman |
| 5,638,558 | A | * | 6/1997 | Moore ..... 5/81.1 T |
| 5,642,537 | A | | 7/1997 | Johnson |
| 5,781,943 | A | | 7/1998 | Moenning et al. |
| 5,802,632 | A | | 9/1998 | Campbell |
| 5,820,616 | A | * | 10/1998 | Horney ..... 604/378 |
| 5,850,642 | A | * | 12/1998 | Foster ..... 5/81.1 C |
| H001788 | H | * | 2/1999 | Christon et al. ..... 604/385.101 |
| 6,698,041 | B2 | | 3/2004 | VanSteenburg et al. |
| 6,857,143 | B2 | | 2/2005 | McNulty |
| 6,932,209 | B2 | | 8/2005 | Kasagami et al. |
| 7,047,578 | B2 | | 5/2006 | Spanton |
| 7,540,043 | B2 | | 6/2009 | Stackley et al. |
| 7,540,044 | B2 | | 6/2009 | Patterson et al. |
| 7,571,498 | B2 | | 8/2009 | Jewell et al. |
| 7,578,011 | B2 | | 8/2009 | Johnson |
| 7,650,654 | B2 | | 1/2010 | Lambarth et al. |
| 7,748,062 | B2 | | 7/2010 | McNulty |
| 7,861,336 | B2 | | 1/2011 | Patterson et al. |
| 8,112,833 | B2 | | 2/2012 | Patterson et al. |
| 8,434,174 | B2 | | 5/2013 | Patterson et al. |
| 8,448,272 | B2 | | 5/2013 | Patterson et al. |
| 8,453,276 | B2 | | 6/2013 | Hillenbrand, II |
| 8,601,619 | B2 | | 12/2013 | McNulty |
| 8,791,321 | B2 | * | 7/2014 | Love et al. ..... 604/378 |
| 2001/0047543 | A1 | | 12/2001 | VanSteenburg et al. |
| 2003/0163870 | A1 | * | 9/2003 | Porter et al. ..... 5/490 |
| 2003/0182723 | A1 | | 10/2003 | Kasagami et al. |
| 2005/0055768 | A1 | * | 3/2005 | Assink ..... 5/81.1 R |
| 2005/0066442 | A1 | | 3/2005 | Kasagami et al. |
| 2006/0174405 | A1 | | 8/2006 | Johnson |
| 2006/0225202 | A1 | | 10/2006 | Stackley et al. |
| 2006/0282946 | A1 | | 12/2006 | Meyer |
| 2007/0056096 | A1 | * | 3/2007 | Assink ..... 5/81.1 HS |
| 2007/0277318 | A1 | | 12/2007 | Rak |
| 2008/0216231 | A1 | * | 9/2008 | Lambarth et al. ..... 5/81.1 HS |
| 2009/0004452 | A1 | * | 1/2009 | Assink ..... 428/220 |
| 2009/0159396 | A1 | | 6/2009 | Wood |
| 2011/0072582 | A1 | * | 3/2011 | Patterson et al. ..... 5/484 |
| 2011/0152641 | A1 | * | 6/2011 | Fernfors et al. ..... 600/309 |
| 2012/0084914 | A1 | | 4/2012 | Patterson et al. |
| 2012/0186012 | A1 | | 7/2012 | Ponsi et al. |
| 2012/0186013 | A1 | * | 7/2012 | Ponsi ..... 5/81.1 R |
| 2012/0216345 | A1 | | 8/2012 | Hand |
| 2012/0291196 | A1 | | 11/2012 | Konda |
| 2013/0180046 | A1 | | 7/2013 | Davis, Jr. |

OTHER PUBLICATIONS

"SureHands Lift & Care Systems, Self-Care Systems, Recreational Lifts," Catalog, Handi-Move International, 2011. 64 pgs.

"SureHands Frictionless Slides for safe patient handling in simpler transfers," Handi-Move International, 2011. 4 pgs.

International Search Report and Written Opinion of related International Application No. PCT/US2013/036830 mailed on Aug. 15, 2013.

* cited by examiner

SYSTEMS, METHODS AND TRANSFER SHEETS FOR TRANSFERRING PATIENTS

CROSS-REFERENCE TO RELATED APPLICATIONS

This application is a continuation in part of U.S. patent application Ser. No. 13/626,457 by Ty A. White and Aaron J. Emerson, SYSTEM AND METHOD FOR TRANSFERRING PATIENTS, filed Sep. 25, 2012, issued Jul. 22, 2014 as U.S. Pat. No. 8,782,826, which claims the benefit under 35 U.S.C. §119(e) of prior U.S. Provisional Patent Application No. 61/624,527, filed Apr. 16, 2012, each of which is hereby incorporated by reference herein, in the entirety and for all purposes. This application is related to co-pending U.S. application Ser. No. 14/153,800 by Ty A. White and Aaron J. Emerson, SYSTEMS AND METHODS FOR TRANSFERRING PATIENTS, filed on even date herewith.

BACKGROUND

This disclosure relates generally to patient transport in hospital and clinical environments, and other medical or patient care settings. In particular, the disclosure relates to the physical process of patient transfer from one surface to another, for example between beds or gurneys in an operating room, or in an examination, laboratory, treatment or recovery location.

In the day to day operations of a hospital, many patients are moved. In many instances, patients are ambulatory and can move from a hospital bed to a wheelchair to be moved yet again. Many patients are not ambulatory. These patients must also be moved with the assistance of nursing and medical staff. Non-ambulatory patients are moved from a hospital bed to a gurney whenever there is a need to move a patient to a new area. Once moved to the new area, they are moved again into a new room or other environment.

When a patient undergoes surgery, even the ambulatory patient is generally rendered non-ambulatory due to the effects of anesthesia. Generally, the anesthesia does not wear off shortly after concluding the operation. A patient is generally moved from the operating table in an operating suite to a bed in a recovery room. In the recovery room, the patient is observed until they "wake up" after the anesthesia wears off. In the recovery room, a nurse can also keep an eye on many patients in the event something should go wrong shortly after an operation.

Once the patient awakens or recovers sufficiently, the patient is then moved again to a hospital room. Most patients are rendered non-ambulatory by virtue of the operation. As a result, the nursing and medical staff must move the patient onto a gurney for transport back to the recovery room. Generally, the patient stays on the gurney while in the recovery room. Upon recovery, the patient is then moved on the gurney to the hospital room. Once at the hospital room, the patient is moved from the gurney to the hospital bed by medical staff, or the nursing staff.

A common prior art device used to move a patient is shown in FIGS. 1 and 2. The transportation (or transport) device 100 includes a number of elongated rollers 110 (or 111, 112, 113, 114, 115, 166, 117) that are covered by a mesh cloth or vinyl belt 130. A sheet of material 150 is wrapped around the device 100. The patient is rolled from a supine position to a lateral decubitus position (a so called "log roll"), at which time the device is placed between the patient and the surface of the bed or gurney, or other surface on which the patient is lying. The patient is then rolled from the lateral decubitus position back to a supine position onto the device and the cloth material 150 covering the device 100. The patient is rolled onto the device 100 with the assistance of nursing or medical staff.

At this point, the patient is generally only partially on the device 100. The medical or nursing staff may have to push and/or pull the patient across the device to effect a transfer across surfaces. Once on the transportation device 100, the patient must be pushed and/or pulled across and over the device 100. The patient rolls over the transportation device 100 and the individual rollers as the patient is transported to the next surface.

The current device has potential problems. The ride for the patient may be uncomfortable, as the dorsal aspect of the patient does not move smoothly across the belt surface due to the open spaces between the rollers, which are located beneath the belt. This bumpy ride is stressful on patients being transported. For example, patients that have just completed an operation are many times still being monitored during transport and into the recovery room. The monitoring information taken during transport, such as heart rate, ECG (electrocardiograph), blood pressure, and respiratory rate show that the patient undergoes stress.

Another potential problem is related to the hospital staff, such as the nursing staff or medical staff. In moving the patient, the staff must bend over two surfaces and push and/or pull the patient. This method is inherently inefficient due to accepted principles of physics, e.g., friction. This can cause injuries and resulting workman's compensation claims. Also, for patients of significant size and/or weight, additional hospital staff may be required for the physical task of moving the patient from one surface to another with the existing transportation device. These injury and labor force issues can add substantially to the cost of operating a hospital.

SUMMARY

Various examples and embodiments described herein relate to a method and a system for transferring objects, such as patients or other bodies, in a hospital or clinical setting, for example in an operating suite. Additional examples and embodiments relate to patient transfer devices, patient transfer systems, and materials for use with such systems, including, but not limited to, single-use transfer sheets configured for patient transfer using the patient transfer devices. Further examples and embodiments relate to devices, systems and methods for transferring a patient or other body between surfaces, for example between beds, gurneys or other locations in a hospital operating room, and in other clinical, laboratory, examination, treatment, transportation and recovery environments.

DETAILED DESCRIPTION

Patient Transport

Figure 1:
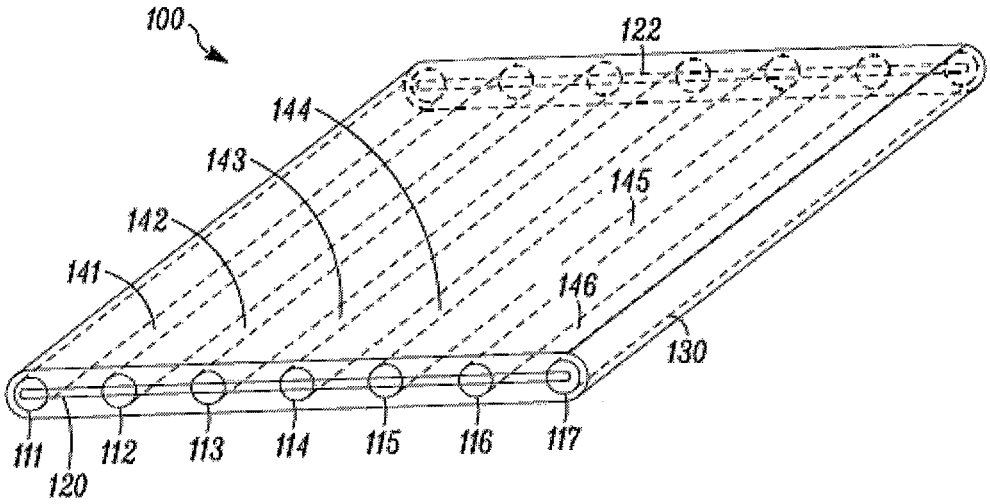
FIG. 1 (PRIOR ART)
FIG. 1 is a perspective view of a prior art patient transportation device.

FIG. 1 is a perspective view of a prior art patient transport (or transportation) device 100. The prior art patient transport device 100 includes a number of parallel spaced elongated rollers 111, 112, 113, 114, 115, 116, 117 which are spaced from one another. A frame member 120 and a frame member 122 hold the rollers in spaced relation to one another. The frame members 120, 122 are attached to the ends of the rollers 111, 112, 113, 114, 115, 116, 117. Each end of the roller 111, 112, 113, 114, 115, 116, 117 is rotatably attached to the frame member 120, 122. The frame members 120, 122 are tied to one another so as to form a substantially rigid frame. The rollers 111, 112, 113, 114, 115, 116, 117 are covered by a continuous belt 130. The continuous belt 130 is sized so that it fits tightly over the rollers 111, 112, 113, 114, 115, 116, 117.

It should be noted that there are spaces 141, 142, 143, 144, 145, 146 between the rollers 111, 112, 113, 114, 115, 116, 117. In the spaces 141, 142, 143, 144, 145, 146 there may be essentially no support. The continuous band or belt 130 of the prior art is generally flexible.

When supporting an object in the spaces 141, 142, 143, 144, 145, 146 between the rollers 111, 112, 113, 114, 115, 116, 117 the continuous band or belt 130 flexes or sags. When an object is small it travels between a high position on top of a roller 111, 112, 113, 114, 115, 116, 117 and lower position in a space, such as spaces 141, 142, 143, 144, 145, 146 between the rollers 111, 112, 113, 114, 115, 116, 117. When a large flexible object is transported using the transport device, a flexible outside surface of the object will travel between these positions.

In some instances, a human being is transported using the prior art transport device 100. Human beings and other animals have an integumentary system. The integumentary system is the organ system that protects the body from damage, and includes the skin and its appendages (including, e.g., hair, scales, feathers, and nails, depending on the corresponding animal characteristics). The integumentary system has a variety of functions, such as to waterproof, cushion, and protect the deeper tissues, and to excrete wastes and regulate temperature. The integumentary system is also the attachment site for sensory receptors to detect pain, sensation, pressure, and temperature. In humans, the integumentary system is the largest organ system.

When a human body is the object being moved, first portions of the integumentary system are supported by the elongated rollers 111, 112, 113, 114, 115, 116, 117, while adjacent portions of the integumentary system are supported at lower positions by the belt 130, spanning spaces 141, 142, 143, 144, 145, 146 between the rollers 111, 112, 113, 114, 115, 116, 117. This is due to the flexible nature of skin in its function to cushion organs within the body. As a human is transported over the device 100, the skin or integumentary system undulates. This is stressful on the body. The stress occurs both when the human is conscious and unconscious.

During surgery, the body is carefully monitored. The monitoring continues after surgery. For certain medical or surgical procedures, some patients require monitoring during transfer from the surgical surface to the transport surface. Other patients are also monitored as they convalesce in a post-surgery recovery room. Monitoring information such as heart rate, ECG (electrocardiograph), blood pressure, and respiratory rate indicate that the patient undergoes stress during transfer.

In addition to producing stress, the transport device 100 also translates as the patient is moved. In other words, the elongated rollers 111, 112, 113, 114, 115, 116, 117 roll along the continuous belt 130, which, in turn, is rolled over the surfaces between which the patient is being transported. Such an arrangement can result in high localized loading at the rollers and may require more force to move a patient.

Figure 2:
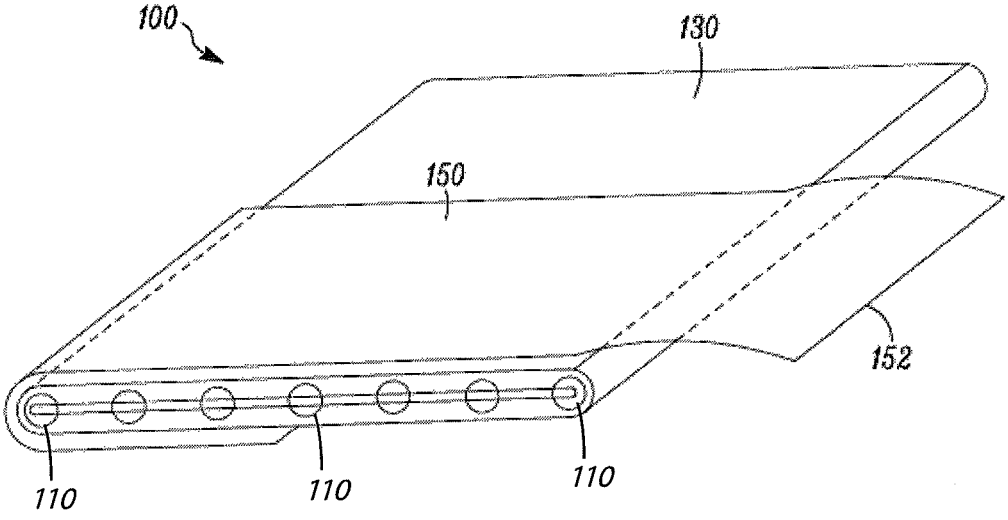
FIG. 2 (PRIOR ART)
FIG. 2 is a perspective view of the prior art patient transportation device, with a sheet of material wrapped around the device.

FIG. 2 is a perspective view of a prior art patient transport device 100 with a sheet of material 150 wrapped around the patient transport device 100. In operation, a clean cloth material 150 is wrapped around the patient transport device 100. The edge 152 of the material is generally gathered by workers on one side of the human. The material 150 is then pulled along the edge.

Other workers can push the human to help move or transfer the patient from one surface to the other surface. Pushing on the human body adds to stress. The workers generally must bend, push and pull, and this causes the workers stress as well, which can result in injury.

At the end of its use, the material 150 is placed in the laundry, laundered and reused.

System Design

Figure 3:
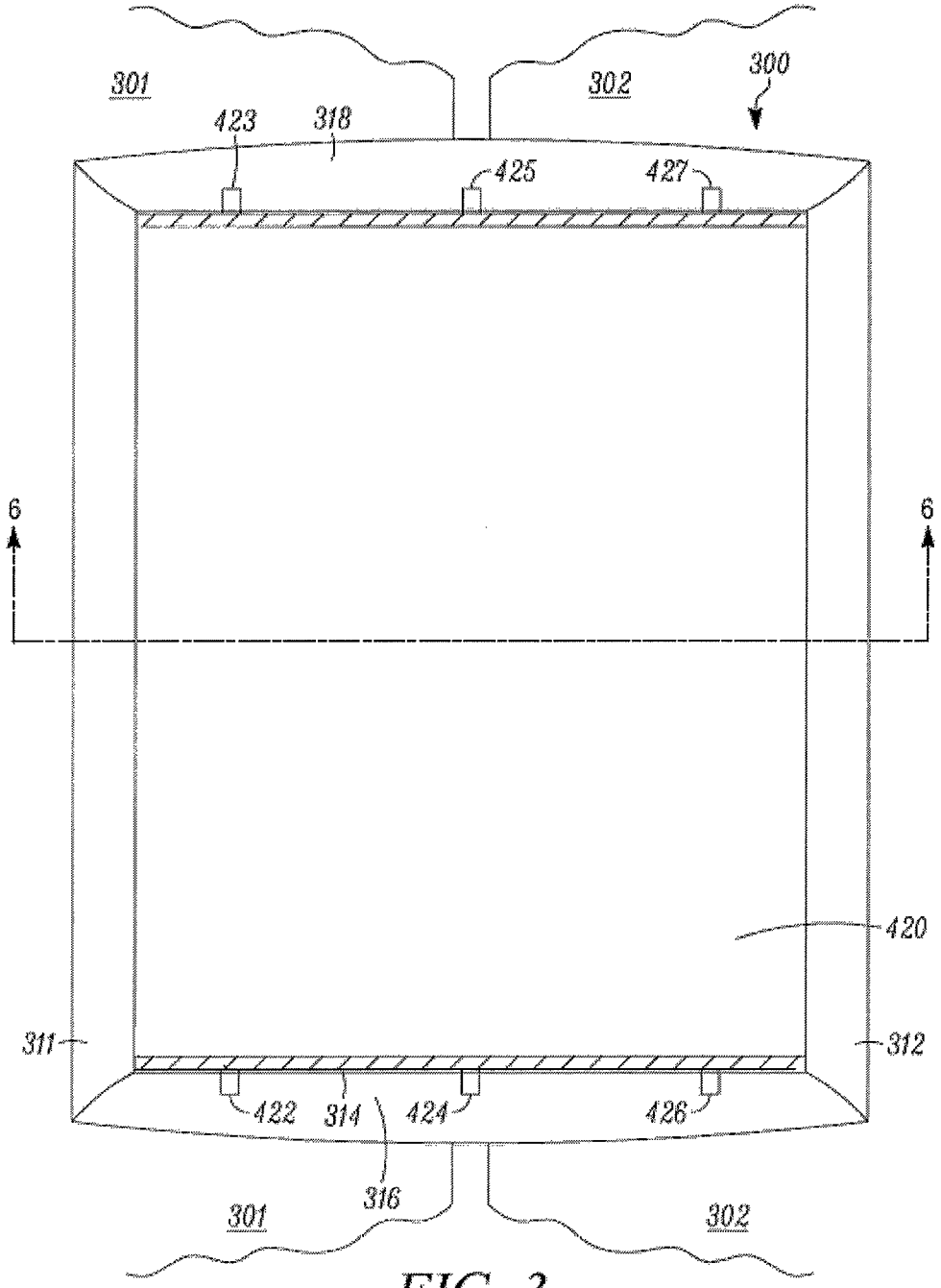
FIG. 3 is a top view of a patient transfer system according to an exemplary embodiment of the present disclosure.
Figure 4:
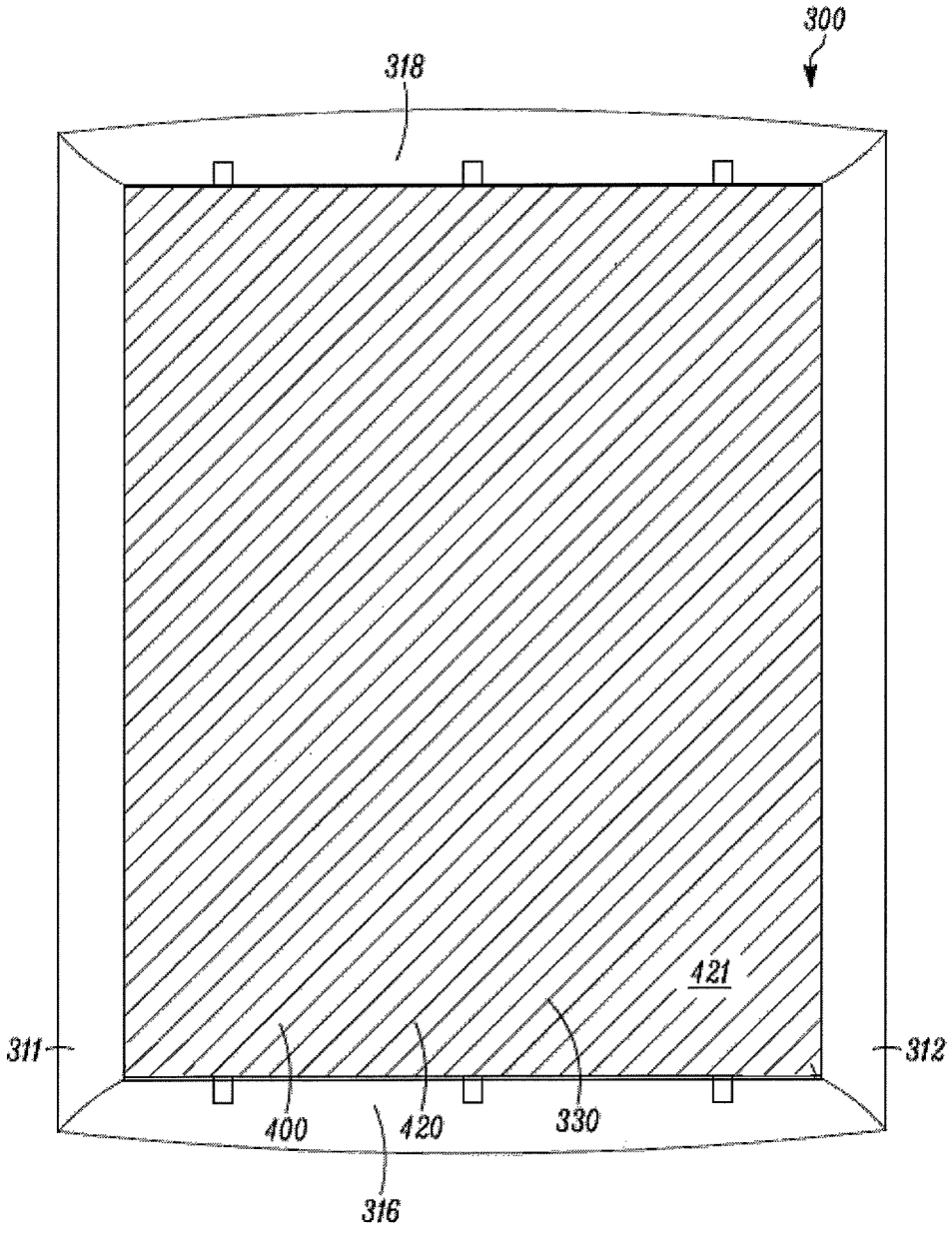
FIG. 4 is a top view of the patient transfer system in an embodiment with a continuous belt.

FIG. 3 is a top view of a patient transport device or transfer system 300 as used to move a patient or other object or body from a first surface 301 to a second surface 302, according to an exemplary embodiment of the present disclosure. FIG. 4 is a top view of a patient transfer system 300 as used to move a patient or other body from a first surface to a second surface with a continuous belt, according to an exemplary embodiment.

Figure 5:
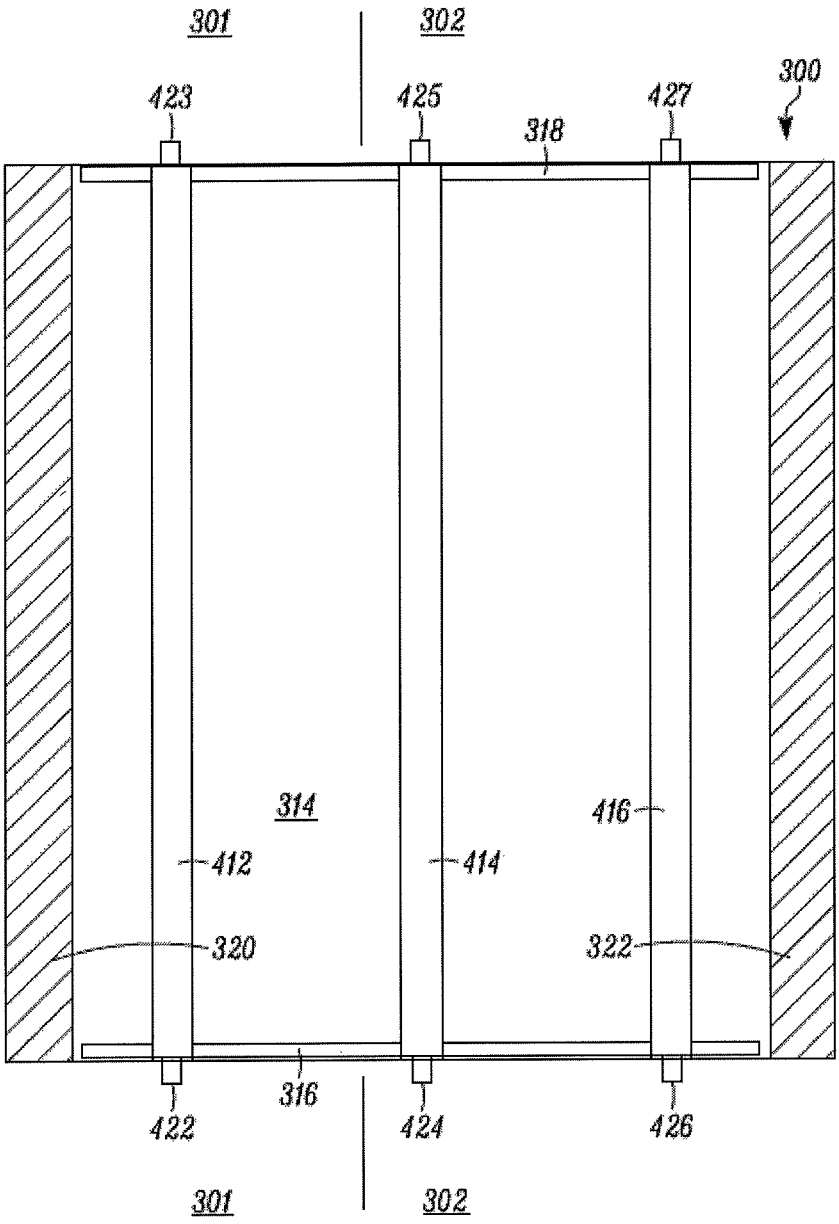
FIG. 5 is a top view of the patient transfer system with the continuous belt and a portion of the support system removed.

FIG. 5 is a top view of a patient transfer system 300 as used to move a patient from a first surface 301 to a second surface 302, with the continuous belt 330 and a portion of a support system 400 removed, according to an exemplary embodiment of the present disclosure. Specifically, the end caps and the side caps of the housing are removed from FIG. 5. The bridge cover material is also removed from FIG. 5.

Figure 6:
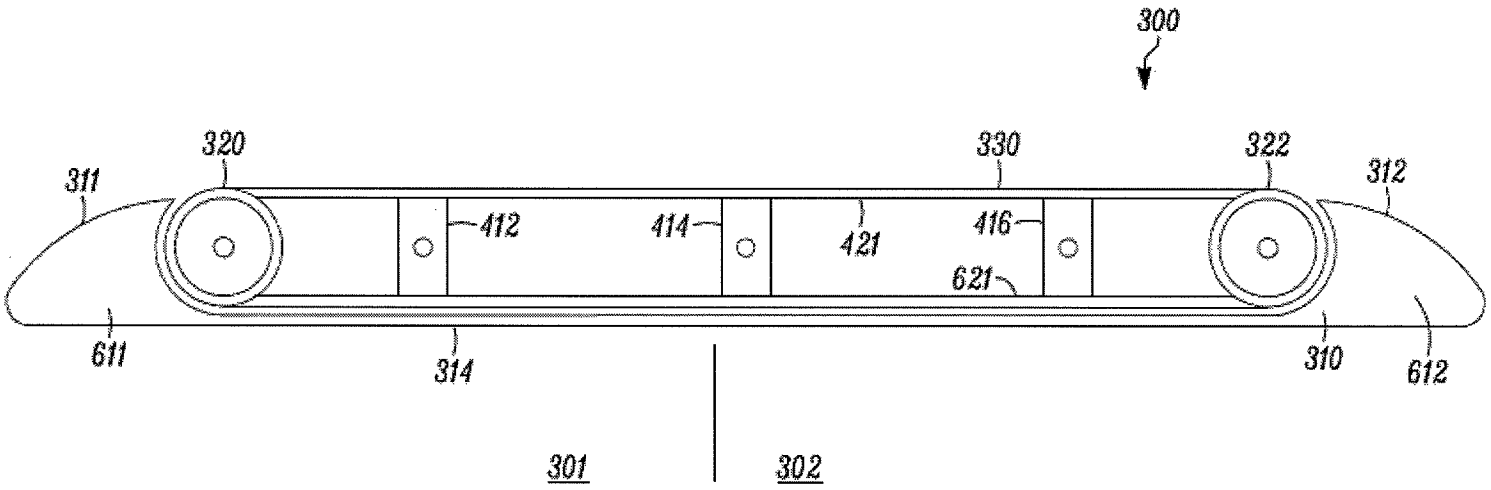
FIG. 6 is a cross-sectional view of the patient transfer system.

FIG. 6 is a cross sectional view of a patient transfer system along line 6-6 in FIG. 3, according to an exemplary embodiment. Now referring to FIGS. 3-6, the patient transfer system or apparatus 300 will be further detailed.

The patient transfer system 300 includes a housing 310 dimensioned to span a distance between the first surface 301 and the second surface 302. The housing 310 is also made sufficiently strong so as to have the strength to not fail while spanning the distance. The patient transfer system 300 may include a first elongated roller 320 positioned along a first edge or first side cap 311 of the housing 310, and a second elongated roller 322 positioned along a second edge or second side cap 312 of the housing 310.

The patient transfer system also includes a support system or structure 400. The support system 400 includes a set of individual supports 412, 414, 416 (e.g., as shown in FIGS. 5 and 6). The individual supports 412, 414, 416 are attached to the end caps 316, 318 of the housing 310. For example, individual support 412 is attached to housing end cap 316 at point 422 and to the housing end cap 318 at attachment point 423, individual support 414 is attached to housing end cap 316 at point 424 and to the housing end cap 318 at attachment point 425, and individual support 416 is attached to housing end cap 316 at point 426 and to the housing end cap 318 at attachment point 427.

A top bridge cover 421 is attached to the individual supports 412, 414, 416 to form a bridge 420. The bridge 420 can also have a bottom bridge cover 621 (e.g., as shown in FIG. 6). The bridge covers 421, 621 can be formed of a substantially rigid material, such as a low friction polymer or carbon fiber, plastic, metal or metal composite fiber material.

The top bridge cover 421 flexes a limited amount during transport of an object, such as a patient, but may be much more rigid than a belt material. The bridge 420 supports the object as it is transported using the patient transfer system 300. When the object is a patient, the patient is supported so that the skin or the integumentary system undulates less than when the prior art device 100 is used. This reduces the stress placed on the patient when moved with the patient transfer system 300 when compared to the prior art device 100. The bridge 420, in one embodiment, forms a support surface having a first portion which is substantially the same height as the first elongated roller 320 and a second portion which is substantially the same height as the second elongated roller 322.

The patient transfer system 300 may also include a continuous belt 330. The continuous belt 330 is positioned in conveying relation with respect to the first roller 320 and the second roller 322 and with respect to the bridge 420. The first roller 320, the second roller 322, a major portion of the supports 412, 414, 416 and a major portion of the bridge 420 are positioned within the continuous belt 330. A portion of the continuous belt 330 conveys the body while another portion of the continuous belt 330 passes through the housing 310.

The housing 310 includes a bottom 314. The bottom 314 includes a first major surface abutting the first surface 301 and the second surface 302, and includes a second major surface on the inside of the housing. The continuous belt 330 does not touch the first surface 301 or second surface 302. The continuous belt 330 passes over the second major surface. In other words, the continuous belt passes over the top of the second major surface on the inside of the housing 310.

The elongated rollers 320, 322 are positioned substantially within the housing 310 and above the second major surface of the bottom 314 of the housing 310. In another embodiment, the surface of the bridge 420 of the support system 400 is approximately the same height as one of the first end and the second end of the housing. The continuous belt passes over the support structure and specifically over the support surface as the continuous belt is moved to transfer the body. The support surface, in some embodiments, includes a material which lessens the friction occurring between the support surface and the belt.

Now looking at FIG. 6, in some exemplary embodiments, the support structure 400 of patient transfer system 300 also includes a bottom cover 621 attached to the supports 412, 414, 416. The cover 621 is also positioned within the housing 310. The cover 621 acts to guide the continuous belt 330. The cover 621 also prevents the continuous belt from catching on the supports 412, 414, 416. The support system 400 includes the bridge 420 which can be thought of as a frame covered by a bridge cover 421 and a bridge cover 621.

In another embodiment, the support system can be formed of a solid material. In still other embodiments, the number of supports forming the frame can be varied. Furthermore, different types of materials can be used for the bridge cover 421 and the bridge cover 621. Bridge cover 421 is on one side of the supports 412, 414, 416 and bridge cover 621 is on the other side of the supports 412, 414, 416.

In one exemplary embodiment, the continuous belt 330 is made of an elastomeric material so as to cushion the object to be transferred. The continuous belt 330 may be sufficiently thin so as to fit between the space between the roller 320 and the edge 311, and the space between the roller 322 and the edge 312 of the housing 310. The thickness of the belt 330 can also be selected to allow the belt to flex. In other words, the belt material 330 may be sufficiently flexible so that it can wrap around the rollers 320, 322 and most of the support system 400.

If the object to be moved is a human, the elastomeric material of the continuous belt 330 cushions the patient during a transfer. In another embodiment, a thinner cloth-like material is used in the continuous belt 330. It should be noted that any suitable type of material that is sufficiently flexible and sufficiently thin to fit between a roller and an edge of the housing can be used.

When the continuous belt 330 is made of an elastomeric material it somewhat conforms to the body during transfer. When the body to transfer is that of a human being or animal, the conformance of the belt provides some comfort to the animal or human being.

The continuous belt can be sufficiently thin so as to remain clear of the housing during operation of the continuous belt. The continuous belt can also be sufficiently thin so as to allow the use of a transfer sheet. If the continuous belt is too thick, the belt could become caught within the housing, for example. If the continuous belt is too thick, it may allow the continuous belt to be used but prevent operation of the device when a transfer sheet is used.

In one embodiment, the first and second elongated rollers 320, 322, respectively, are positioned inboard with respect to the first edge or side end cap 311 and the second edge or side end cap 312 of the housing 310.

In the embodiment shown in FIGS. 3-6, the first edge or side end cap 311 of the housing 310 includes a transition area 611 between a lower portion of the housing 310 and the support surface or surface of the bridge 420. The second edge or side end cap 312 of the housing 310 also includes a transition area 612 between a lower portion of the housing 310 and the support surface or surface of the bridge 420. The transition area can be made in any number of suitable shapes.

As seen in FIG. 6, the first transition area 611 and the second transition area 612 are triangular in cross-sectional shape. The triangular-like shape allows the housing 310 of the system 300 to be placed near the patient or object to be moved and slightly wedged into the space.

The less slope between the edge or end caps 311, 312 of the housing 310 and the bottom of the housing 314, the gentler the transition area 611, 612. The transition area 611, 612 is generally longer with gentler slope. The transfer device 300 will be wider with transition areas having a gentler slope.

The width of the transfer device 300 is one consideration in the design of the device. Other design considerations can be the comfort of a human, when the human is the object to be moved, or the bulkiness of the device 300 when handled by hospital personnel in an operating suite or around the hospital.

Transfer Sheet

Figure 7:
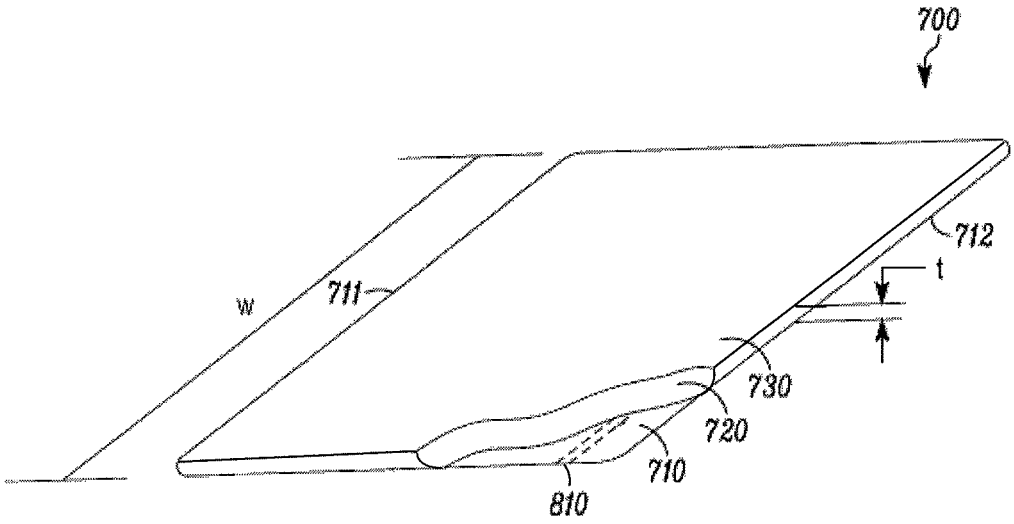
FIG. 7 is a partial cut away view of the single-use transfer sheet, according to an exemplary embodiment of the present disclosure.
Figure 8:
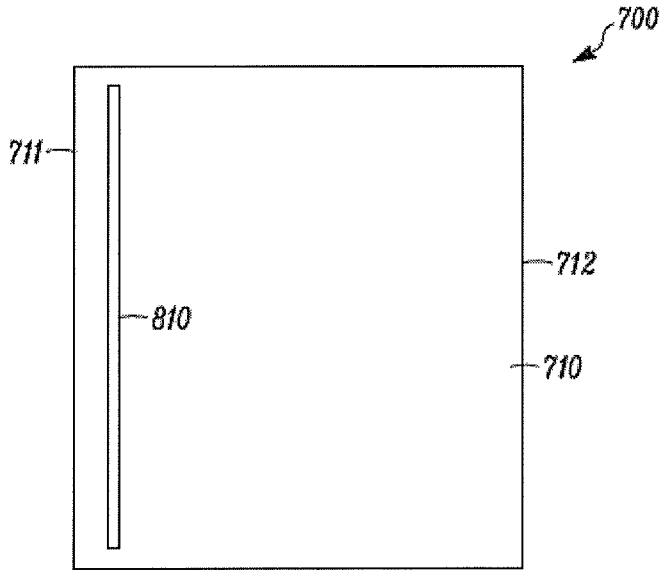
FIG. 8 is a bottom view of the single-use transfer sheet.

FIG. 7 shows a partially cut away perspective view of a transfer sheet 700, according to an exemplary embodiment. FIG. 8 shows a bottom view of the transfer sheet 700, according to an exemplary embodiment. Depending on embodiment, transfer sheets 700 may be provided in single-use or disposable form, or as a multi-use (e.g., washable or launderable) material. Transfer sheets 700 may also be referred to informally as "chux" or "chucks."

In operation a transfer sheet 700 is used to provide additional cushioning and to provide a clean surface on which to transport a body. The transfer sheet, in the embodiment shown, also may include absorbent material. In another embodiment, the transfer sheet is formed from a permanent material and is adapted to receive an absorbent material. The absorbent material will absorb fluids that may be produced or come from the patient. Any suitable sort of absorbent material can be used.

There may be limits as to the thickness of the transfer sheet 700. The transfer sheet 700, when used, fits in a space between the outer surface of the continuous belt 330 when positioned on one of the rollers 320, 322 and the edge 311, 312 of the housing respectively. The thickness is denoted by the variable "t" shown in FIG. 7.

The transfer sheet 700 has a width, W. In embodiments, the width, W, is less than the width of the continuous belt 330, whereas with a width of the transfer sheet 700 wider than the continuous belt 330, the transfer sheet 700 may bind the transfer device 300.

Looking at FIG. 7, the transfer sheet 700 includes a bottom layer 710, an absorbent layer 720 and a top layer 730. The various layers 710, 720 and 730 are made of clean material. The various layers may also be made of single-use or disposable materials.

The top layer 730 is permeable or will allow fluids to pass to the absorbent layer 720. The transfer sheet 700 also includes a first edge 711 and a second edge 712. In one embodiment, the edges 711, 712 are perforated or have the earmarks from a perforated connection to another transfer sheet.

FIG. 8 shows that the bottom layer 710 includes an adhesive strip 810 toward one edge, such as edge 711 of the transfer sheet 700. The adhesive strip 810 can be a single elongated strip or can be several smaller strips laid end to end to form an elongated adhesive strip near the edge 711. In another embodiment, the adhesive strip can be multiple strips or multiple elongated strips near one of the edges 711 of the transfer sheet 700. In one embodiment, the strips can be parallel to one another and parallel to the edge 711.

The adhesive used is generally a releasable type of adhesive, such as an adhesive similar to that used on a POST-IT note from 3M of St. Paul, Minn. The releasable adhesive will allow the strip to be applied to a surface and removed without leaving an adhesive residue on the surface.

In still another embodiment, the adhesive strip is covered with a strip of material to seal the adhesive until it is exposed for use. This material may be of the peel and stick type. The transfer sheet 700 can be bunched up along one of the edges 711, 712 and used to move an object such as a patient. In one embodiment, the transfer sheet 700 can include hand hold openings.

System Storage

Figure 9:
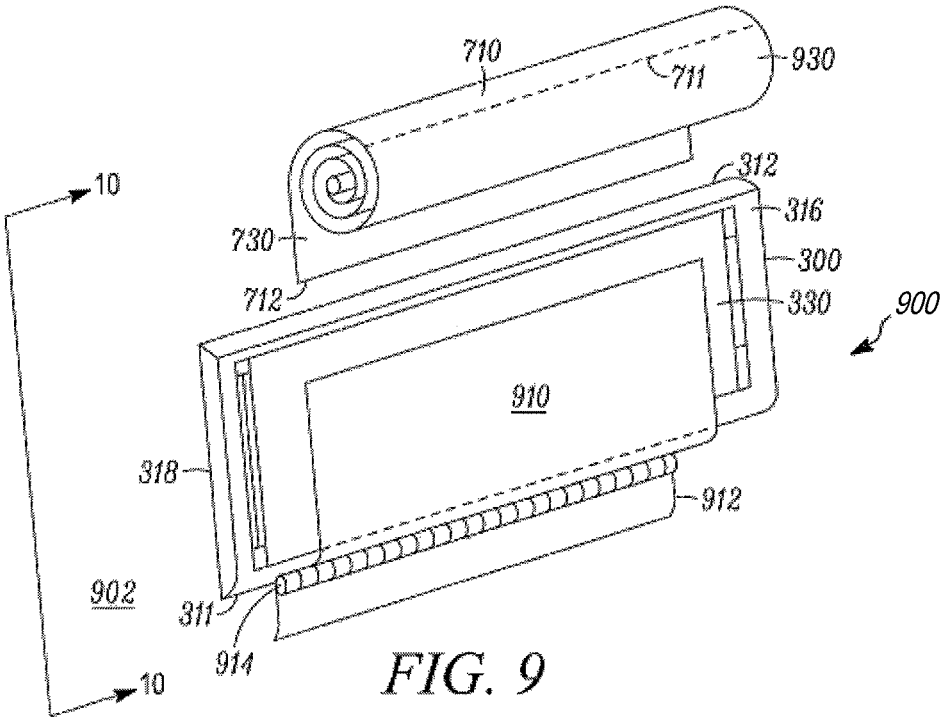
FIG. 9 is a perspective view of a wall mounted bracket for storing the patient transfer system, according to an exemplary embodiment of the present disclosure.
Figure 10:
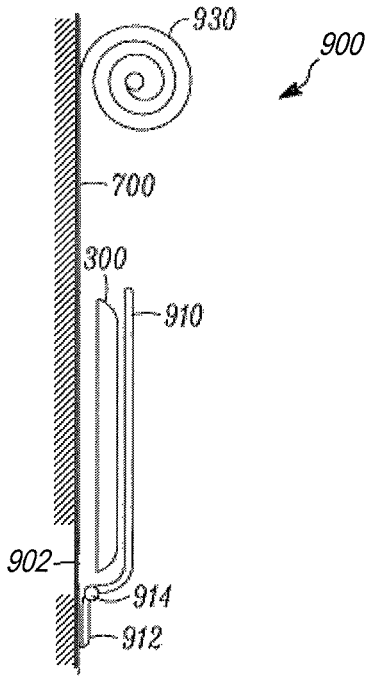
FIG. 10 is an end view of the wall mounted bracket.

FIG. 9 shows a wall mounted bracket 900 for the patient transfer device 300 and roll 930 of transfer sheets 700, according to an exemplary embodiment. FIG. 10 is an end view of the wall mounted bracket 900 for the patient transfer device 300 and roll 930 of transfer sheets 700, according to the exemplary embodiment.

Now referring to both FIGS. 9 and 10, the details of the wall mount bracket and roll 930 of transfer sheets 700 will be further detailed. The wall mount bracket 900 is attached or mounted to a substantially vertical surface, such as a wall 902.

The wall mounted bracket 900 has an upper portion 910 and a lower portion 912. The upper portion 910 is substantially parallel with the lower portion 912. The lower portion 912 abuts the wall 902. The lower portion 912 is attached to the wall via any suitable type of fastening device, such as lag bolts, screws, or the like. The lower portion 912 can be attached using an adhesive. In some embodiments, both an adhesive and one or more fasteners are used to attach the lower portion 912 of the wall bracket 900 to the wall 902.

When attached, the upper end 910 is free and spaced from the wall at a distance which is greater than the width of the patient transfer device 300. The patient transfer device can then be stowed along the wall, and produce a minimal footprint. The patient transfer device 300 also does not interfere with the ground. In many instances, for example, the floor is kept clean so having the patient transfer device off the floor is helpful in that it does not need to be moved to clean a room.

The wall bracket 900 can be used in any type of room, including surgical suites, patient rooms, or hallways near a plurality of patient rooms. The device can also be used in transport vehicles, such as ambulances or helicopters, or rescue boats.

Stored above the wall mounted bracket 900 is a roll of transfer sheets 700. The transfer sheets 700 are formed in a roll 930 and can be easily deployed.

In use, the patient transfer device 300 is removed. A transfer sheet is torn off the roll along a perforated edge, such as edge 712. The adhesive can then be used to removably attach the transfer sheet 700 to the belt 330 of the transfer device 300. In other embodiments, the transfer sheet 700 may be attached to the patient transfer device 300 before being removed from the storage spot of the wall mounted bracket 900.

In one embodiment, the upper portion 910 of wall mounted bracket 900 is attached to the lower portion by a spring hinge 914. The spring hinge 914 allows the upper portion 910 to fold down and provide a substantially vertical working surface for the patient transfer device 300 as a transfer sheet is being loaded thereon. After the transfer sheet 700 is loaded onto the patient transfer device 300, the spring hinge 914 moves the upper portion 910 back to a position proximate the wall to which the wall bracket 900 is mounted.

In still another embodiment, the roll of transfer sheets can be placed or mounted in a suitable housing. The housing can be attached to an appropriate surface. The housing protects the roll of transfer sheets 700.

Method of Operation

Figure 11:
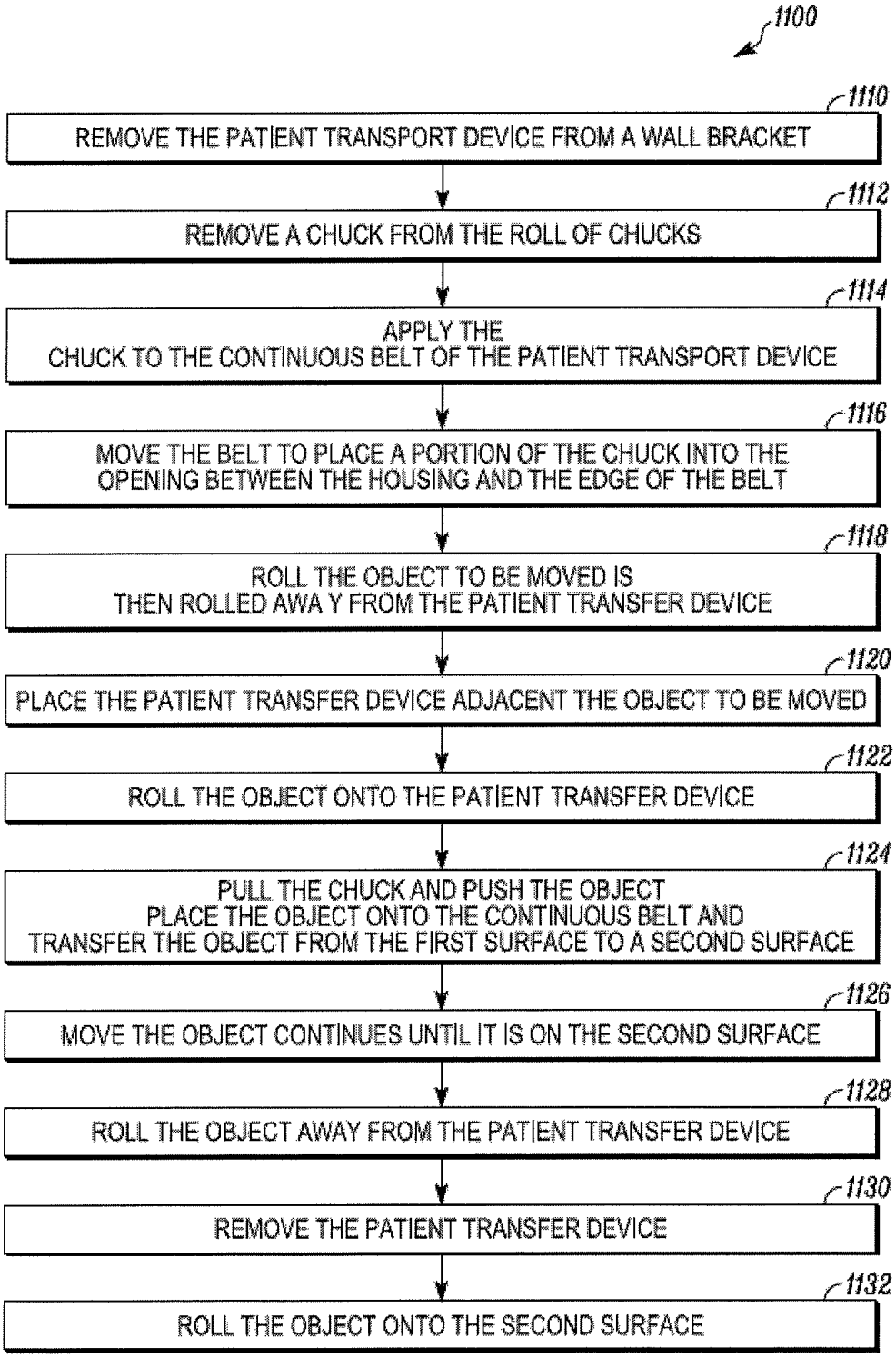
FIG. 11 is a flow diagram of a method for operation of a patient transfer device and transfer sheet, according to an exemplary embodiment of the present disclosure.

FIG. 11 shows a flow diagram of a method 1100 for operation of the patient transfer device and transfer sheet, according to an exemplary embodiment. The patient transfer device 300 is removed from a wall bracket (step 1110), and a transfer sheet 700 is removed from the roll of transfer sheets (step 1112). The transfer sheet 700 is applied to the continuous belt 330 of the patient transfer device (step 1114).

Applying the transfer sheet to the continuous belt includes removing a peel and stick type covering from an adhesive strip, and placing the adhesive strip of the transfer sheet onto the continuous belt of the patient transfer device. Generally, the adhesive strip will be applied to the belt near the edge that will be initially placed under the patient. The belt is moved to place a portion of the transfer sheet into the opening between the housing 310 and the edge of the belt 330, as depicted herein (step 1116). This may be referred to as loading the transfer sheet onto the patient transfer device (step 1116).

The patient or other body to be moved is then rolled away from the patient transfer device (step 1118), the patient transfer device is placed adjacent the patient (step 1120), and the patient is then rolled back onto the patient transfer device (step 1122). The patient or other body to be moved is now partially on the patient transfer device. The transfer sheet can then be pulled and the body pushed to place the patient onto the continuous belt and transfer the patient from the first surface to a second surface (step 1124).

At least one portion of the transfer sheet contacts the continuous belt. The patient continues to be moved until it is on the second surface (step 1126). The patient can then be tilted or rolled away from the patient transfer device (step 1128), and the patient transfer device can then be removed (step 1130) and the patient can be rolled onto the second surface (step 1132).

Transfer Sheet Materials

Figure 12:
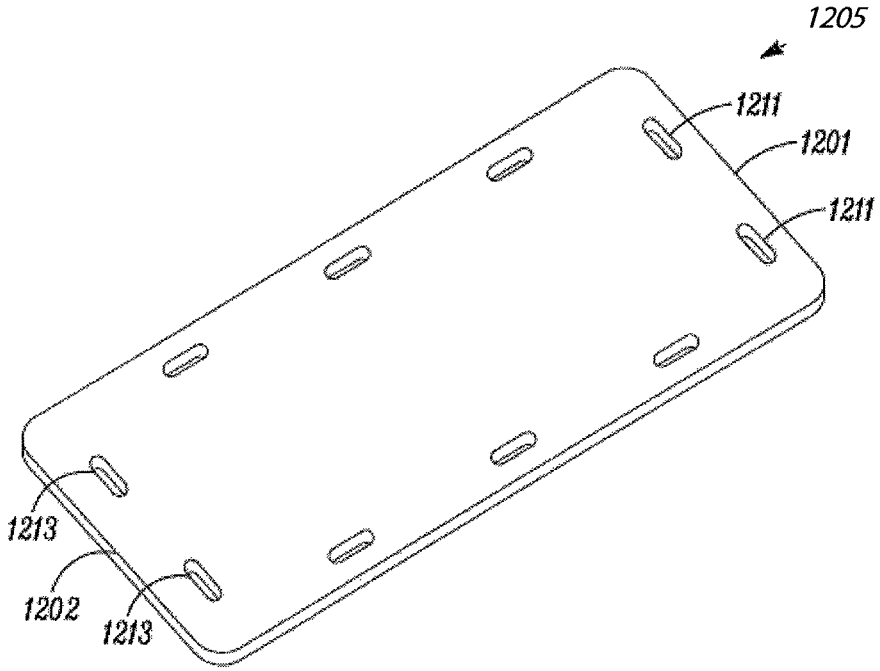
FIG. 12 is a perspective view of a supplemental transfer sheet for use in the transfer device, according to an exemplary embodiment of the present disclosure.

FIG. 12 shows a supplemental sheet 1205 that can be used to add strength to the transfer sheet 700 during a patient transfer, according to an exemplary embodiment of the present disclosure. When the patient is heavy or above a certain weight, there is a possibility that the transfer sheet 700 may not hold up to the pulling forces needed to move the patient. As a result, a sheet 1205 of a thicker and stronger material can be provided, which supplements and adds to the system.

As shown, the sheet is a relatively thin and tough plastic sheet that is dimensioned so that it fits on the continuous belt 330, 1850. In operation, the sheet 1205 fits between the transfer sheet 700 and the continuous belt 330, 1850. For example, the sheet can be positioned when it is determined that the body to be moved, such as a heavy patient, may be large enough so that pulling on the transfer sheet 700 alone may rip the transfer sheet 700. Alternatively, the supplemental sheet 1205 can be bonded to the transfer sheet 700, for example to the bottom surface of transfer sheet 700, in a laminated transfer sheet configuration.

The sheet 1205 is made of a tough plastic that can be grabbed and moved with little chance of tearing. In one exemplary embodiment, the sheet 1205 is made of polyethylene having a thickness of approximately 20 mils.

As shown, the sheet 1205 has a first edge 1201 and a second edge 1202. The sheet 1205 can have a first set of handholds 1211 positioned near the first edge 1201 and a second set of handholds 1213 near the second edge 1202. In another embodiment, the sheet can, include a foam material. The foam material provides for further cushioning of the body during transport. In some embodiments, the foam is added to the sheet 1205 to provide a composite sheet that is both strong and cushioned. In another embodiment, the sheet may be entirely made of foam material.

Drive System and Controls

Figure 13:
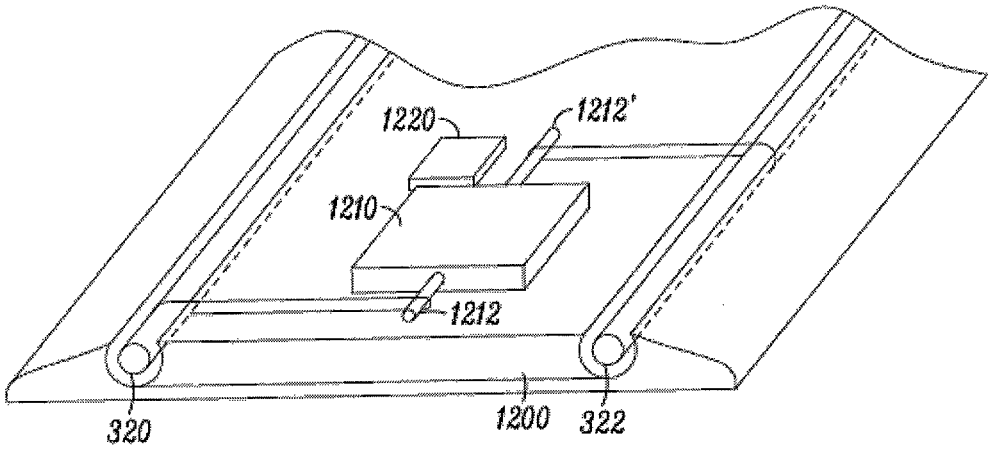
FIG. 13 is a schematic view of the transfer device with a drive system, according to an exemplary embodiment of the present disclosure.

In some embodiments, the patient transfer device 300 includes a drive mechanism 1210. FIG. 13 shows a schematic view of a transfer device 1200 with a drive system or motor 1210, according to an exemplary embodiment.

The drive mechanism, in one embodiment, includes an electric motor or drive system 1210, such as a brushless induction motor. The electric motor turns a shaft or shafts 1212 and 1212' coupled to at least one or both of the elongated rollers 320, 322. The shaft 1212, 1212' turns and drives the rollers 320, 322. The shaft 1212, 1212' turns one way to rotate the roller in a first direction and turns another way to turn the roller in the opposite direction. In one embodiment, shafts 1212, 1212' are connected so that rollers 320, 322 can be rotated freely to override the drive motor 1210.

In one embodiment, the motor 1210 includes a gearbox having a set of pawls that are used to drive the shaft in a first direction. If the rollers are turned faster than the driven speed, the pawls merely ride over an adjacent drive position to allow the rollers to free wheel in the driven direction. This is helpful in the event the drive mechanism is not moving fast enough and the people overseeing the transfer of the patient want to expedite the transfer, such as in an emergency situation. In addition, if there is a loss of power, it may be necessary in order to move the patient, or other body to be transferred.

As discussed above, the patient transfer device may be bi-directional because the shafts 1212, 1212' can be driven in a first direction and in a second direction. The second direction may be the reverse or opposite the first direction.

It is contemplated that sensors can be used to automatically determine which way to drive the rollers. In one embodiment, accelerometers are used to detect tilt and to detect which of the sides of the transfer device 300 contacts a surface first. This will generally indicate the side of the transfer device 300 that is placed under the patient or other body or object to be moved. In another embodiment, each edge of the transfer device 300 is provided with a stress or strain gauge. The stress or strain gauge can be used to detect a force, such as a partial weight of a patient or other body or object on one edge of the transfer device.

In either embodiment, detecting the patient or other body to be moved using a strain gauge or by detecting the tilt of the device 300, the top surface or exterior portion of the continuous belt is driven away from the patient or other body to be moved so as to move the patient or other body to a position on the surface of the device 300. In some embodiments, inertial activation is used to determine the direction to drive the belt. It should also be noted that one or more of these types of sensors can be combined to form a more robust system.

In one embodiment, the electric motor is powered by a battery. In one exemplary embodiment, the wall bracket can include a charger system that charges the battery by induction technology. The motor within the patient transfer device 1200 may be an induction motor.

The charger may be provided within the wall bracket 900 and positioned in charging relation to the motor within the patient transfer device 1200. Induction or contact points can be located within the patient transfer device. The battery within the patient transfer device 1200 is then charged whenever the patient transfer device is placed in the wall mounted bracket 900. Therefore, the battery 1220 will be charged and ready when the patient transfer device is needed. After use, the patient transfer device 1200 is placed in the wall mount bracket and recharged again.

In another embodiment, the charger can also be placed in the wall near the wall bracket. In still other embodiments, the wall bracket 900 includes a series of stops to correctly position the patient transfer device with respect to the wall bracket so that the charger within the wall bracket is able to charge the battery 1220.

Figure 14:
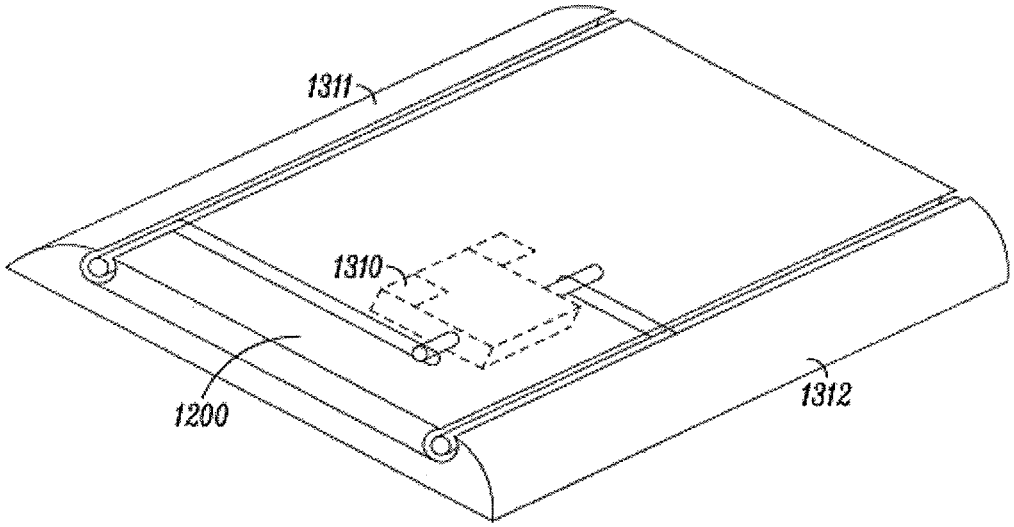
FIG. 14 is a schematic illustration of the control system, in an embodiment responsive to sensors used to detect the position of the patient.

FIG. 14 is a schematic of a control system that acts in response to a set of sensors associated with the transfer device 1200, according to an exemplary embodiment. The patient transfer system or transport device 1200 includes a controller 1310 for controlling the electric motor 1210 used to drive the patient transfer device 1200.

The patient transfer device 1200 may also include sensors, such as a sensor 1311 and a sensor 1312. Sensor 1311 is associated or positioned on or within a first edge of the housing of the patient transfer device. Sensor 1312 is associated or positioned on or within a second edge of the housing of the patient transfer device 1200. The sensors 1311, 1312 are used to detect the position of the body or other object to be transported.

The sensors 1311, 1312 can be any type of suitable sensor including an optical sensor, a heat sensor, a gyroscopic sensor, an inertial sensor, or a strain gauge, or the like. An optical sensor detects the body in response to a reduced amount of light occurring at one sensor when compared to another optical sensor. A strain gauge will detect weight added to the housing in the area of the sensor location. A heat sensor can sense heat of a patient or other body, for example should the object to be moved be a human being. A gyroscopic sensor senses the axis plane position of a portion of the patient transfer device 1200. An inertial sensor senses the commencement of movement or the stoppage of movement.

The sensors 1311 and 1312 can be used to control movement or driving of the continuous belt 330 so as to make the patient transfer device user-friendly to hospital personnel using the device to transport a patient. More than two sensors can be used in other embodiments.

Figure 15:
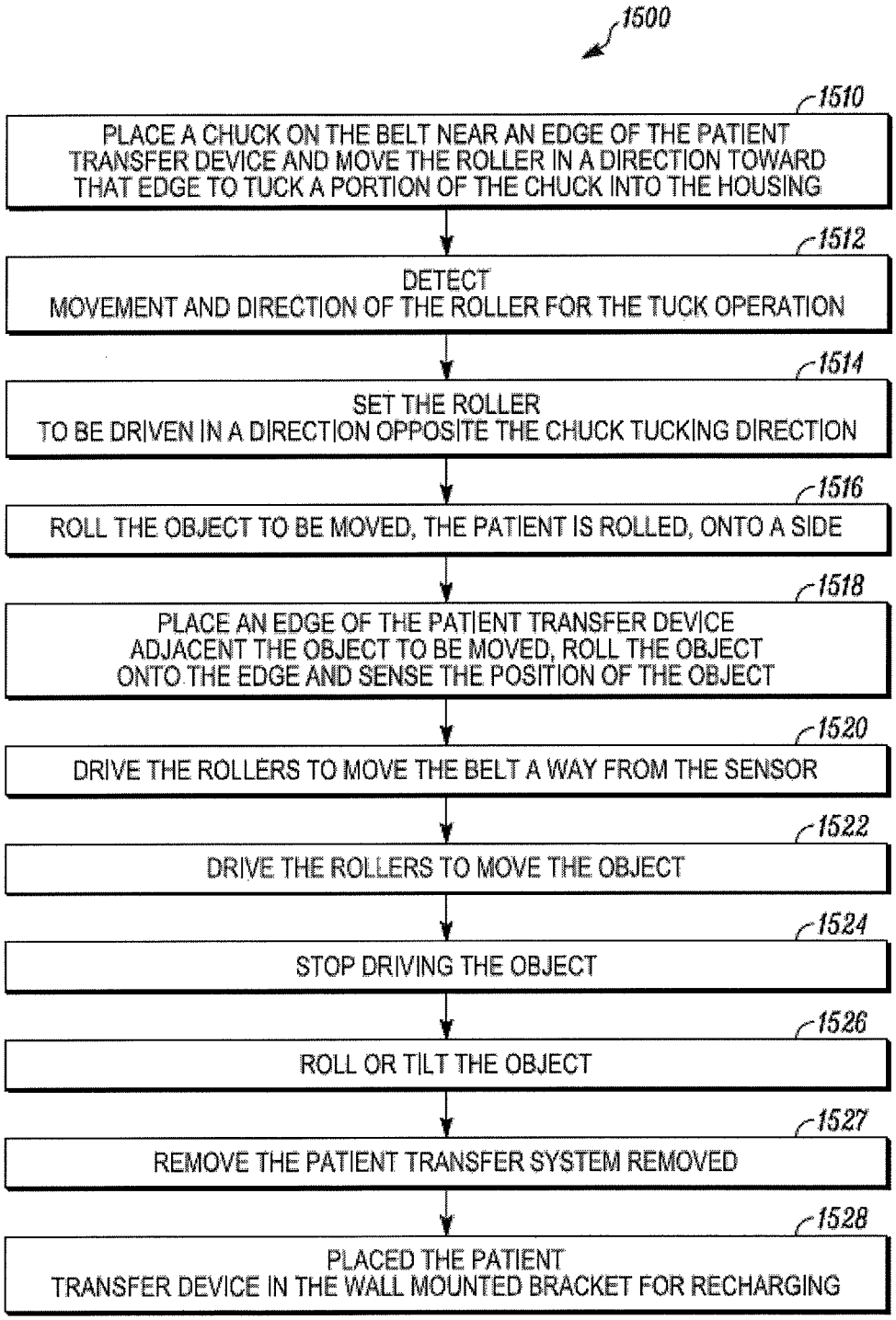
FIG. 15 is a flow diagram for a method of controlling the patient transfer device, according to an exemplary embodiment of the present disclosure.

FIG. 15 is a flow diagram for a method 1500 for controlling the movement of a belt and for driving the belt, according to an exemplary embodiment. If a transfer sheet 700 is placed on the belt near an edge, the roller will be turned in a direction toward that edge so as to tuck the transfer sheet 700 into the housing (step 1510). The controller 1310 can detect movement and direction of the roller for this operation (step 1512) and set the roller to be driven in a direction opposite the transfer sheet tucking direction (step 1514).

The edge carrying the sensor 1311 may be the edge initially placed near the body to be moved. The body is typically rolled away from this edge. For example, if a patient is the body to be moved, the patient can be rolled onto his or her side (step 1516). The edge is placed adjacent the body to be moved, and then rolled onto the edge and over the sensor 1311.

The position of the patient is sensed (step 1518). If sensor 1311 is a light sensor, a signal indicating a lack of light or drop in an amount of light is sent to the controller 1310. The controller 1310 can then drive the rollers to move the belt 330 away from the sensor 1311, as depicted herein (step 1520).

In some embodiments, the controller can detect a lack of light for a set time before actually moving. This can prevent detecting an object when there actually was not such an object (such as a user placing a hand on the sensor 1311). In one embodiment, the sensor 1311 can be compared to the sensor 1312. If the two detect equal levels of light, for example, the room could be dark.

In another embodiment, the sensor can be a stress/strain gauge. When the patient or other body is rolled onto the edge containing the sensor 1311, the stress/strain gauge can detect added weight on the frame or the portion of the frame near the sensor 1311. The sensor 1311 can also detect heat or a warm body to determine that a patient is on the frame.

Once an object has been detected, the drive system 1210 drives the rollers away from the edge with the sensor 1311. The drive system 1210 will drive the rollers to move the body (step 1522) and then stop driving the body (step 1524).

There are many suitable options for stopping the rollers. For example, in one embodiment, the drive system 1210 will drive the rollers to move the body until the sensor 1312 detects the body by way of a lack of light, an increase in weight, or by sensing heat at the sensor 1312. In another embodiment, the drive system 1210 can continue to drive the belt for a set amount of time or for a set distance. In a further embodiment, the belt can be driven until a lack of weight, increased light or heat is no longer sensed at the sensor 1312. In still another further embodiment, the drive system 1210 will stop when the load needed to drive the belt increases, which indicates that the body has traveled to the second surface and may now be resting in part on the second surface.

The horizontal component of force needed to overcome friction on the second surface will cause the load on the motor to go high, and the motor associated with the drive system can then be stopped. The patient can be rolled or tilted (step 1526) and the patient transfer system removed (step 1527) and placed back in the wall mounted bracket for recharging (step 1528).

Discussed above is one exemplary control method. It should be noted that other control methods are possible. For example, a sensor able to detect a level surface can be used. The patient transfer device can be placed on the first and second surface and be substantially level. The transfer sheet 700 can be attached to the belt. When the patient or other body is rolled onto its side, the patient transfer device is typically tilted slightly with the low end being nearest the patient or body. Sensing the tilt toward an edge can be a signal to drive the roller in a direction toward the patient to load the transfer sheet 700. The remaining portion of the control method above can then be carried out, as discussed herein.

Described above is a system that can work with a few sensors. It is contemplated that other sensors can be used and produce inputs to a controller to enhance the ease of use for hospital personnel or others that use the patient transfer system.

For example, gyroscopic technology can also be used to sense certain conditions. A gyroscopic sensor can be used to detect a substantially level condition, such as when the patient transfer device is placed between a first surface and a second surface. Once the level condition is detected, the drive system can be enabled or turned on and readied for use.

Using gyroscopic technology, the device can also be disabled or turned off when it is determined to be at an angle greater than a selected threshold, such as 30 degrees with respect to level or horizontal. Levels can also be used to produce inputs for enabling and disabling the device. A sensor can also provide an input to automatically shut off the device when it is within the wall mounted bracket.

Figure 16:
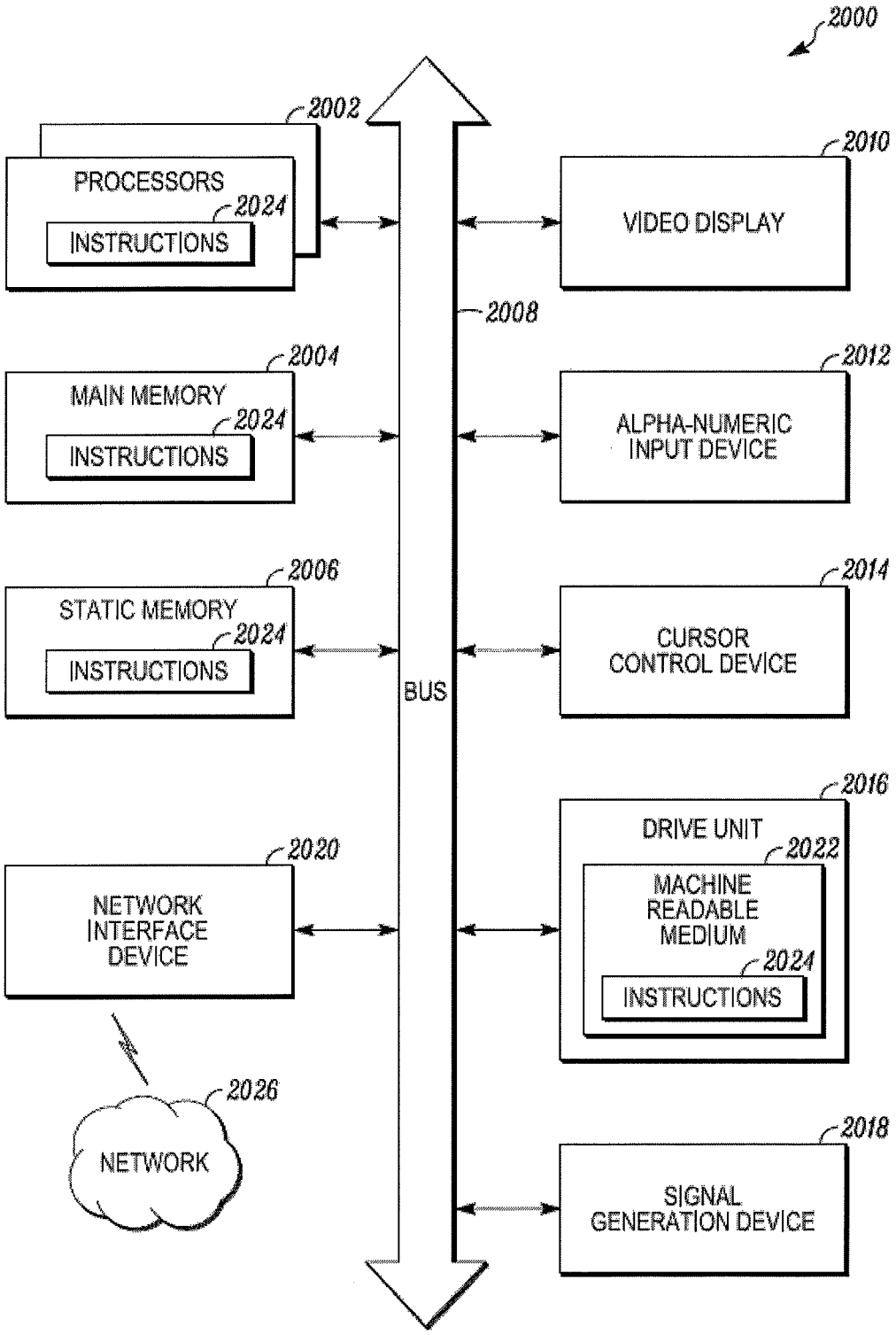
FIG. 16 is a schematic illustration of a computing system configured to execute a set of instructions for performing a method of controlling the patient transfer device, according to an exemplary embodiment of the present disclosure.

FIG. 16 shows a diagrammatic representation of a computing device for a machine in the example electronic form of a computer system 2000, within which is executed a set of instructions for causing the machine to perform one or more of the methods discussed herein, according to one or more exemplary embodiments of the present disclosure. In these various exemplary embodiments, the machine may operate as a standalone device or can be connected (e.g., networked) to other machines. In a networked deployment, the machine can operate in the capacity of a server or a client machine in a server-client network environment, or as a peer machine in a peer-to-peer (or distributed) network environment.

The machine can be a personal computer (PC), a tablet PC, a set-top box (STB), a Personal Digital Assistant (PDA), a cellular telephone, a portable music player (e.g., a portable hard drive audio device such as an Moving Picture Experts Group Audio Layer 3 or MP3 player), a web appliance, a network router, a switch, a bridge, or any suitable machine capable of executing a set of instructions (sequential or otherwise) that specify actions to be taken by that machine. Further, while only a single machine is illustrated, the term "machine" shall also be taken to include any suitable collection of machines that individually or jointly execute a set (or multiple sets) of instructions to perform any one or more of the methodologies discussed herein.

The example computer system 2000 includes a processor or multiple processors 2002 (e.g., a central processing unit or CPU, a graphics processing unit or GPU, an arithmetic logic unit, or any or all of these), and one or both of a main memory 2004 and a static memory 2006, which may communicate with each other via a bus 2008.

The computer system 2000 can further include a video display unit 2010 (e.g., a liquid crystal display or LCD, or a cathode ray tube or CRT). The computer system 2000 can also include an alphanumeric input device 2012 (e.g., a keyboard), a cursor control device 2014 (e.g., a mouse), a disk drive or other storage unit 2016, a signal generation device 2018 (e.g., a speaker) and a network interface device 2020.

The disk drive or other storage unit 2016 includes a computer-readable medium 2022 on which is stored one or more sets of instructions and data structures (e.g., instructions 2024) embodying or utilized by any one or more of the methodologies or functions described herein. The instructions 2024 can also reside, completely or at least partially, within the main memory 2004 and/or within the processors 2002 during execution thereof by the computer system 2000. The main memory 2004 and the processors 2002 also constitute machine-readable media.

The instructions 2024 can further be transmitted or received over a network 2026 via the network interface device 2020 utilizing any one of a number of suitable transfer protocols (e.g., Hyper Text Transfer Protocol or HTTP, CAN, Serial, or Modbus). For example, it is contemplated that an application, for example referred to as an app, can be used with a handheld device, such as a smartphone or mobile device available from various carriers, which can be employed as an interface for controlling the patient transfer device.

Other devices can also be provided with applications that can be used to control the patient transfer system. For example, a mobile phone application can be used to enable or turn on the device and issue certain commands needed to move a body. Thus, an application can be used to convert a mobile phone or smart phone into a remote. A dedicated remote can also be provided with the patient transfer device.

While the computer-readable medium 2022 is shown in an exemplary embodiment to be a single medium, the term "computer-readable medium" should be taken to include a single medium or multiple media (e.g., a centralized or distributed database, and/or associated caches and servers), which store the one or more sets of instructions and provide the instructions in a computer readable form. The term "computer-readable medium" shall also be taken to include any suitable medium that is capable of storing, encoding, or carrying a set of instructions for execution by the machine and which causes the machine to perform any one or more of the methodologies of the present application, or a medium that is capable of storing, encoding, or carrying data structures utilized by or associated with such a set of instructions.

The term "computer-readable medium" shall accordingly be taken to include, but not be limited to, solid-state memories, optical and magnetic media, tangible forms and signals that can be read or sensed by a computer. Such media can also include, without limitation, hard disks, floppy disks, flash memory cards, digital video disks, random access memory (RAMs), read only memory (ROMs), and the like.

The computer system or part of a computer system can be used as the controller 1310 in the drive system of the patient transfer device. In addition, the patient drive system can be provided with any type of suitable interface for receiving signals over a link, such as an internet link, RF link, infrared link or the like.

The exemplary embodiments described herein can be implemented in an operating environment comprising computer-executable instructions (e.g., software) installed on a computer, in hardware, or in a combination of software and hardware. Modules as used herein can be hardware or hardware including circuitry to execute instructions. The computer-executable instructions can be written in a computer programming language or can be embodied in firmware logic.

If written, for example, in a programming language conforming to a recognized standard, such instructions can be executed on a variety of hardware platforms and provide for interfaces to a variety of operating systems. Although not limited thereto, computer software programs for implementing the present method(s) can be written in any number of suitable programming languages such as, for example, Hyper Text Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), JAVA, JINI, C, C++, Perl, UNIX Shell, Visual Basic or Visual Basic Script, Virtual Reality Markup Language (VRML), or using other compilers, assemblers, interpreters or other computer languages or platforms.

System Storage Alternatives

Figure 17A:
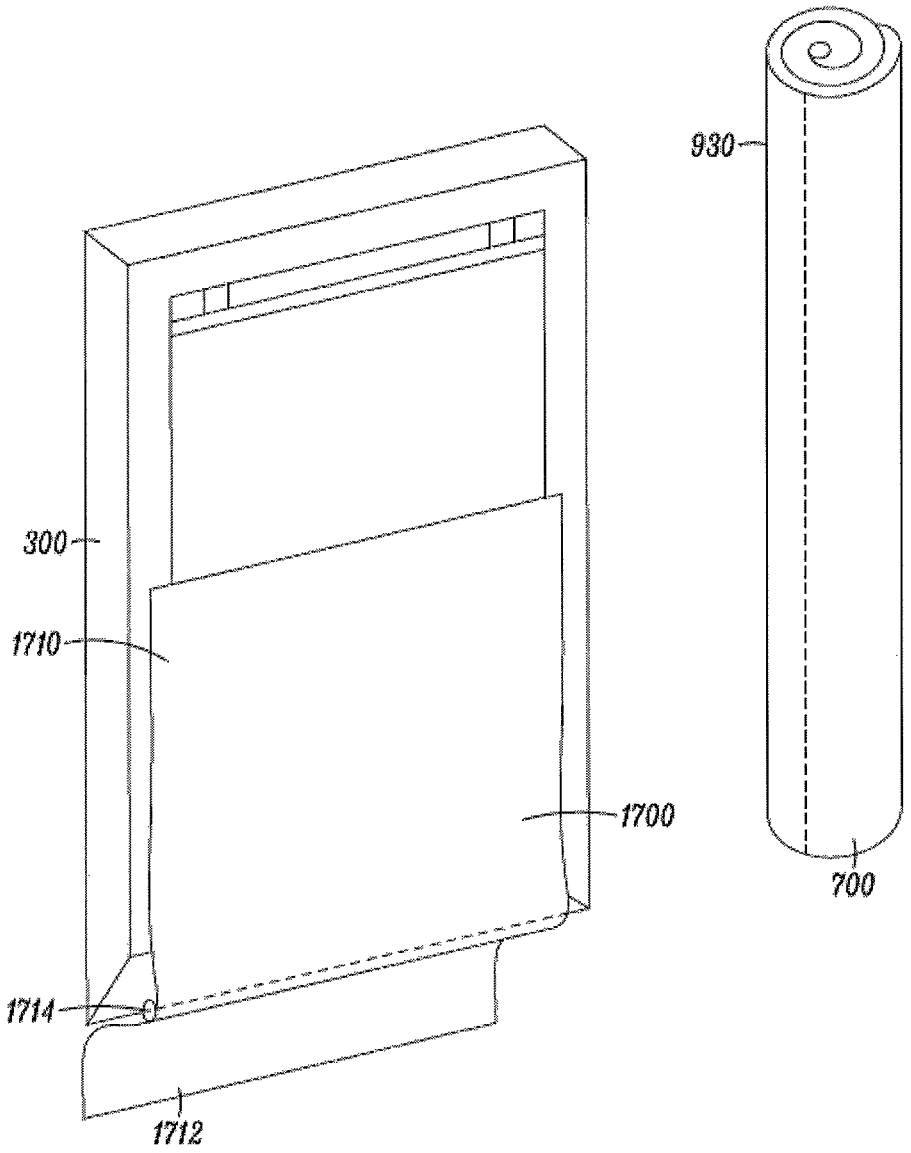
FIG. 17A is a perspective view of an alternate wall mounted bracket for storing the patient transfer device, according to another exemplary embodiment of the present disclosure.

FIG. 17A shows another embodiment of a wall mounted bracket 1700 for the patient transfer device 300 and roll 930 of transfer sheets 700, according to an exemplary embodiment of the present disclosure. In this example, the wall mounted bracket 1700 is mounted in a vertical orientation.

Space in an operating suite can be precious. By orientating the wall mounted bracket 1700 vertically, there is less of a footprint with respect to the floor of the operating suite. In this manner, the wall mounted bracket 1700 can allow space for other equipment to be placed into the operating suite.

In this embodiment, the roll 930 of transfer sheets 700 is also mounted vertically. It should be realized that the roll 930 of transfer sheets 700 can also be mounted horizontally. In fact, one of the wall bracket or roll can be mounted substantially horizontally and the other of the wall bracket or roll can be mounted substantially vertically in various exemplary embodiments.

In each of the various embodiments, the wall bracket 900, 1700 may be provided with a set of contacts for a contact charger. The patient transfer device 300 can have a corresponding set of contacts which make contact with the set of contacts associated with the device 300. The contacts can be used to recharge the motor inside the device 300.

Similarly, the device 300 and the wall mounted brackets can also include a non-contact charging system which can be used to charge the motors associated with the device 300. In one embodiment, the non-contact charging device can include a set of coils associated with the patient transfer device 300 and another set of coils associated with the wall bracket 1700. An alternating current passed through the coils in the wall bracket can induce an alternating current in the coils of the transfer device. These can be rectified and used to charge a storage device, such as a battery.

In such an embodiment, there may be no electrical contacts, which is advantageous if the operatory includes the use of combustible gases and the like. In another embodiment, the wall mounted bracket can be provided with electrical contacts that make contact with the patient transfer device so that it is charged when placed in the wall mounted bracket 1700.

The wall mounted bracket 1700 includes an upper portion 1710 and a lower portion 1712. In one embodiment, upper portion 1710 is attached to the lower portion 1712 by a hinge or spring hinge 1714. The hinge 1714 allows the upper portion 1710 to fold down and provide a substantially vertical working surface for the patient transfer device 300 as a transfer sheet is being loaded thereon. After the transfer sheet 700 is loaded onto the patient transfer device 300, a spring hinge 1714 can move the upper portion 1710 back to a position proximate the wall to which the wall bracket 1700 is mounted.

Figure 17B:
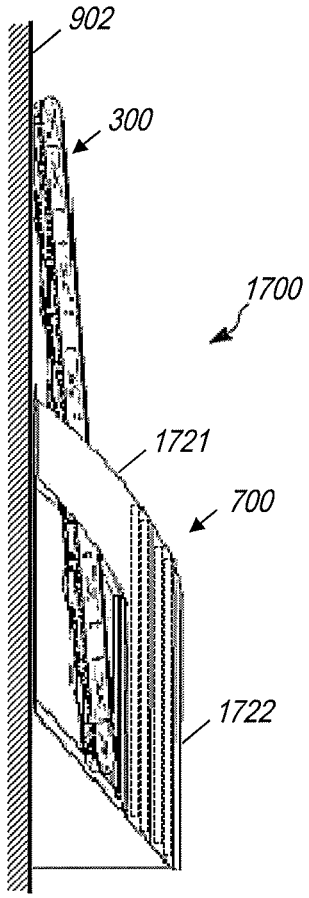
FIG. 17B is a side view of the wall mounted bracket, according to a further exemplary embodiment.

FIG. 17B is a side view of wall mount or storage bracket 1720 according to a further exemplary embodiment, for example mounted to an operating room wall 902. Alternatively, storage bracket (or storage unit) 1720 can be mounted to a wall or similar structure 902 in a nursing station, laboratory, examination room, hallway, or in another hospital, clinical or home care location, or utilized in a transport vehicle.

Suitable materials for manufacturing the storage bracket include, but are not limited to, plastics and other durable polymers, woods, metals, composite materials, and combinations thereof. In the particular example of FIG. 17B, for example, storage bracket 1720 includes first and second housing or storage portions 1721 and 1722, formed of plastic, composite and/or metal materials.

First (device) housing 1721 is attached to a wall or other structure 902 and configured for storing a patient transfer device, for example a device, system or apparatus 300, 1800, 2100 or 2600, as described herein. Second housing 1722 is attached to first housing 1721, and configured for storing one or more transfer sheets or other materials, for example single-use transfer sheets 700, 1900 or 1950, as described herein. Alternatively, second housing 1722 may also be configured for storing additional materials, for example multi-use transfer sheets, linens, and/or spare belts or other parts for the patient transfer device.

Figure 17C:
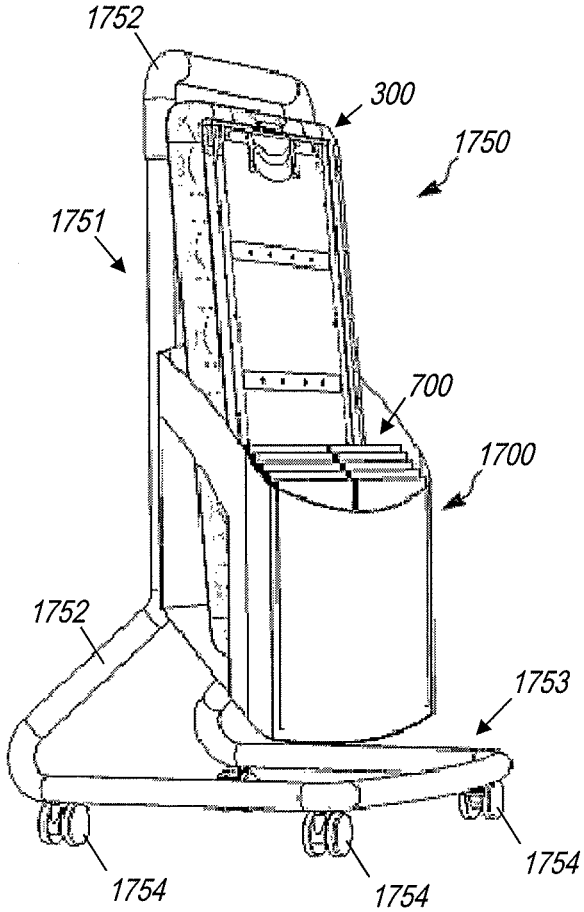
FIG. 17C is a perspective view of a wheeled cart for the patient transfer device, according to an exemplary embodiment of the present disclosure.

FIG. 17C is a perspective view of a wheeled cart 1750, as configured for storing and transporting a patient transfer device according to an exemplary embodiment of the present disclosure. In this particular example, cart 1750 includes a storage unit substantially similar to storage bracket 1720 mounted to a wheeled base 1751, for example with a tubular frame or mount other structure 1752 attached to a wheeled carriage 1753 with one or more wheels or casters 1754.

Suitable materials for making the components of cart 1750 include, but are not limited to, metals, plastics, polymers, composite materials, and combinations thereof, as described above. Storage bracket 1720 can be configured for storing a patient transfer device or apparatus 300, 1800, 2100 or 2600, and/or one or more transfer sheets 700, 900, or 1950, with or without additional linens, parts, and materials, as described herein. Alternatively, cart 1750 may utilize a storage unit substantial similar to storage bracket 900 or storage bracket 1700, or another suitable storage unit configuration.

Design Alternatives—Transport Device

Figure 18A:
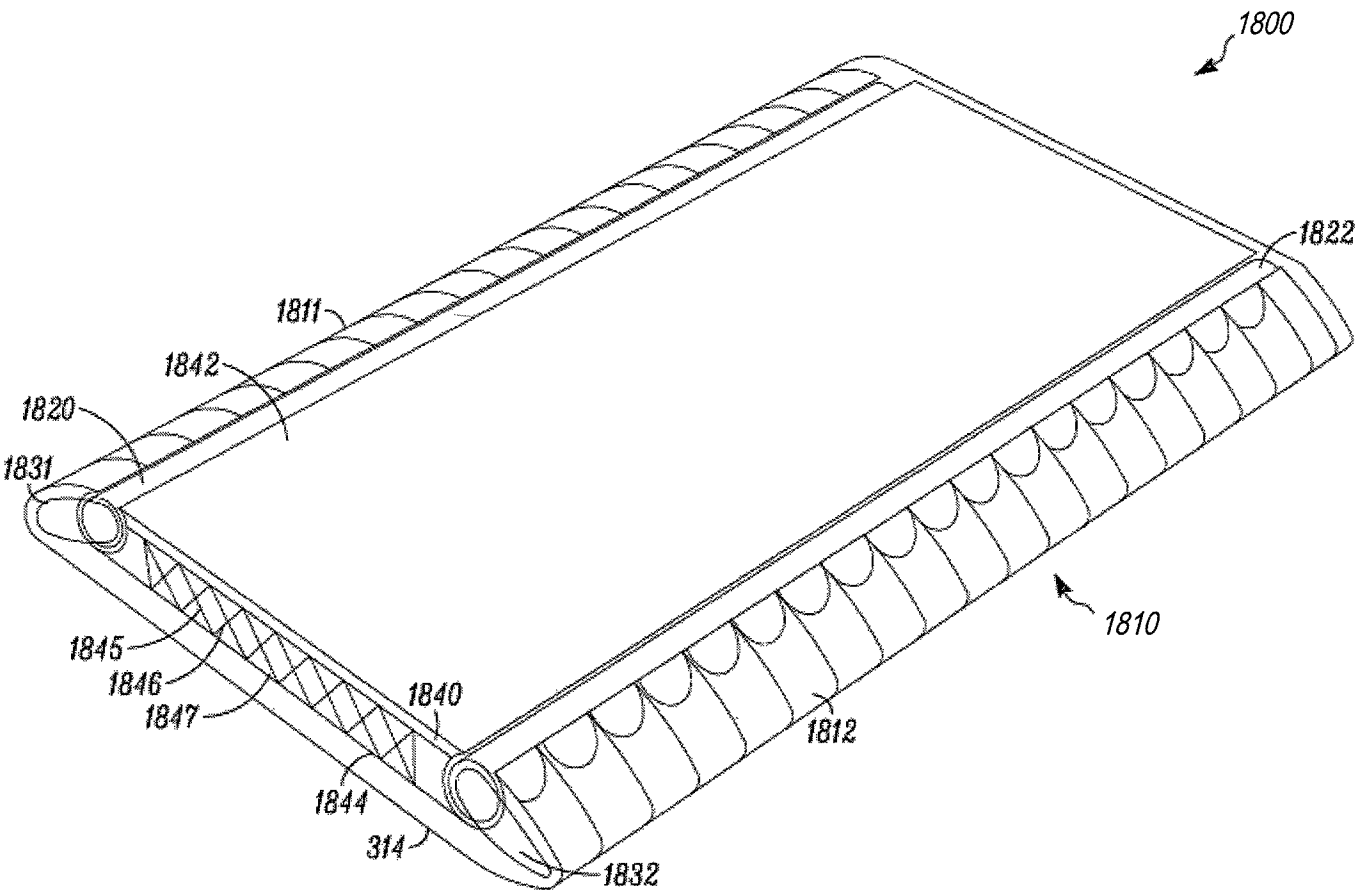
FIG. 18A is a perspective view the patient transfer device, according to an alternate embodiment of the present disclosure.
Figure 18B:
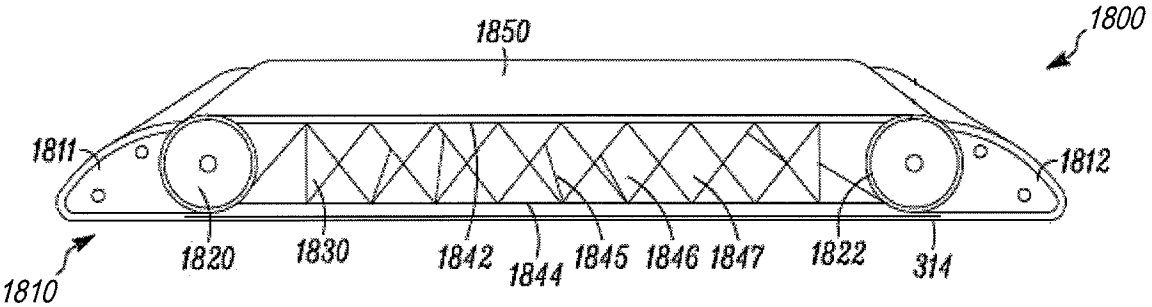
FIG. 18B is an end view of the patient transfer device, according to the embodiment of FIG. 18A.
Figure 18C:
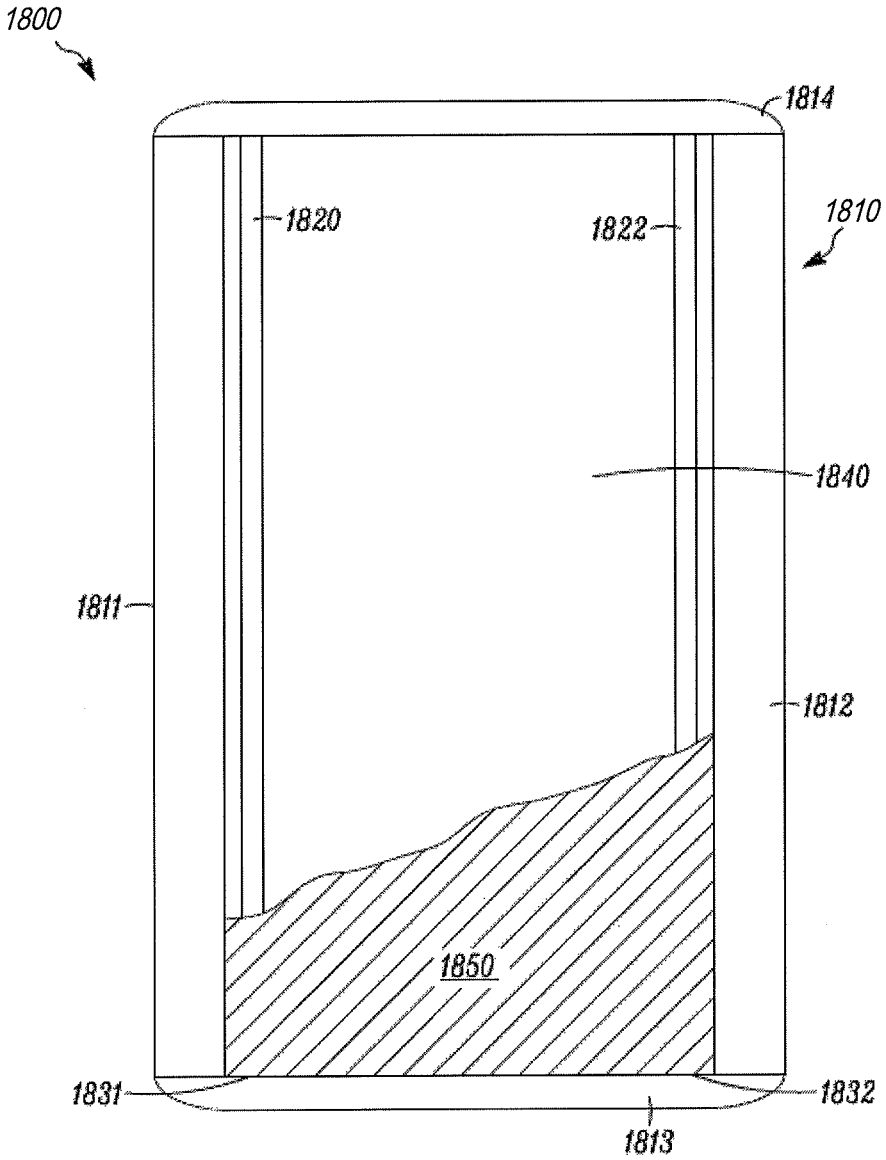
FIG. 18C is a top view of the patient transfer device, according to the embodiment of FIG. 18A.

FIG. 18A shows a perspective view of another exemplary embodiment of the patient transport device 1800. FIG. 18B shows an end view of another exemplary embodiment of the patient transfer device 1800. FIG. 18C shows a top view of another exemplary embodiment of the patient transfer device 1800. Now referring to FIGS. 18A, 18B, 18C, the patient transfer device (alternatively, system or apparatus) 1800 will be further detailed.

The patient transfer system 1800 includes a housing 1810 dimensioned to span a distance between the first surface and the second surface. The housing 1810 includes a first elongated frame member or side cap 1811, a second elongated frame member or side cap 1812, a first end cap 1813, and a second end cap 1814. The end caps 1813, 1814 attach to the first and second elongated frame members or side caps 1811, 1812 to form the housing 1810. The housing 1810 is made sufficiently strong so as to have the strength to not fail while spanning a distance somewhat shorter than the length of the end caps 1813, 1814.

The housing 1810 holds a bridge 1840 which is formed from a material sufficiently strong to hold a patient. The bridge 1840 includes a top bridge cover 1842 and a bottom bridge cover 1844. Located between the top bridge cover 1842 and the bottom bridge cover 1844 is a plurality of truss members including truss members 1845, 1846, and 1847.

In this exemplary embodiment, the truss members are part of a matrix of truss members. The truss members provide strength without making the bridge 1840 overly heavy. The bridge 1840 can be made of metal, plastic, fiberglass or the like. The bridge 1840 can also be made of a composite of several materials or additional materials.

It should be noted that the side caps 1811 and 1812 can also include a system of trusses, as shown in FIG. 18A. In another embodiment, the side caps 1811 and 1812 can be made of a solid material.

The patient transfer system 1800 may also include a first elongated roller 1820 positioned along the first elongated frame member or first side cap 1811 of the housing 1810, and a second elongated roller 1822 positioned along the second elongated frame member or second side cap 1812 of the housing 1810. The patient transfer system 1800 may also include a set of four connector plates. Two of the connector plates are shown in FIG. 18A as elements 1831 and 1832. These are closely spaced with respect to the end cap 1813. It should be understood that there may be additional connector plates positioned near the end cap 1814.

One connector plate 1831 is attached to one end of the side cap 1811 and another connector plate is attached to the other end of the side cap 1811. Similarly, there are two connector plates, including connector plate 1832, which are attached to the ends of the side cap 1812.

The rollers 1820 and 1822 are rotatably attached to two connector plates. The end caps 1813 and 1814, in one embodiment, are also attached to the connector plates. For example, the end cap 1813 attaches to connector plates 1831 and 1832.

The frame or housing 1810, the bridge 1840 and the connector plates form a support system 1830 for the patient transfer system 1800. In one embodiment, the bridge 1840 attaches to the end caps 1813 and 1814. In another embodiment, the end caps 1813, 1814 include indents for receiving the end of the bridge. In this way, the bridge does not have to be connected by hardware but can merely slip into the openings or indents in the end caps 1813, 1814. Alternatively, support system 1830 and bridge 1840 may be combined with housing 1810 to form a substantially unitary or solid structure. In some of these embodiments, there may be no moving belt, with direct contact between the transfer sheet (e.g., lower surface) and the support bridge (e.g., upper surface).

As shown in FIG. 18B, a continuous belt 1850 fits over the rollers 1820, 1822, the top bridge cover 1842, and the bottom bridge cover 1844. The continuous belt 1850 is positioned in conveying relation with respect to the first roller 1820 and the second roller 1822 and with respect to the bridge 1840. FIG. 18B is an end view, and the belt is shown separate from the rollers 1820, 1822, the top bridge cover 1842, and the bottom bridge cover 1844.

As shown in FIG. 18C, the first roller 1820, the second roller 1822, and the bridge 1840 are positioned within the continuous belt 1850. A portion of the continuous belt 1850 conveys a patient or other body and another portion of the continuous belt 1850 passes through the housing 1810. The continuous belt 1850 passes over the top bridge cover 1842, the bottom bridge cover 1844 of the bridge 1840, and the rollers 1820, 1822 while in the housing 1810.

The continuous belt 1850 passes through the housing 1810 and does not contact the major surfaces that a patient is transferred from or to. The continuous belt 1850 passes over the support structure 1830 and specifically over the covers 1844, 1842 and the rollers as the continuous belt is moved to transfer the body. The material used to form the top bridge cover 1842 and the bottom bridge cover 1844, in some embodiments, includes a material which lessens the friction occurring between the covers 1842, 1844 and the belt 1850.

Now looking at FIG. 18B, the patient transfer device 1800 is assembled and the end cap 1813 is removed to more clearly show the truss members of the bridge 1840 which are used to support the covers 1842, 1844. The truss members and covers are made of a material adequate to transport a patient. A factor of safety can be incorporated into the design.

FIG. 18C shows an assembled patient transfer device 1800. The continuous belt is cut away along the length so that the portions of the support systems 1830 are shown.

Design Alternatives—Transfer Sheet

Figure 19A:
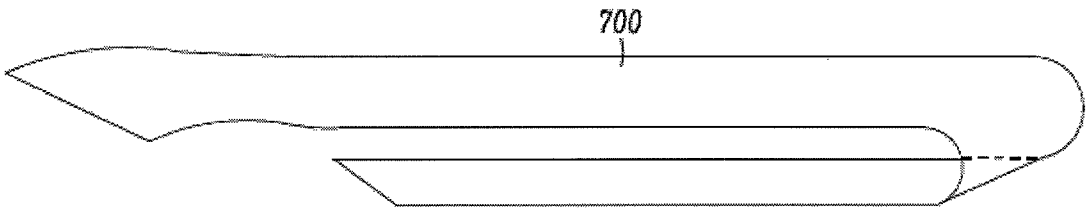
FIG. 19A is a perspective view of a transfer sheet for use with the patient transfer device, according to an exemplary embodiment of the present disclosure.
Figure 19B:
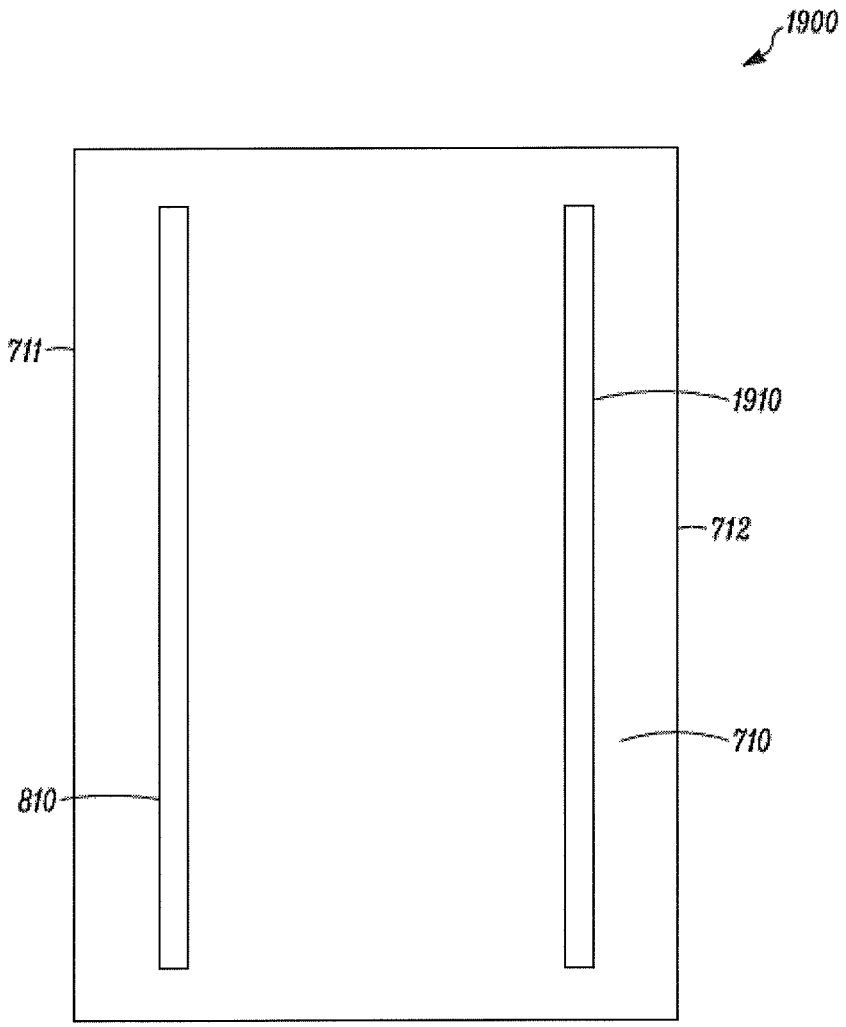
FIG. 19B is a bottom view of the transfer sheet, according to an alternate embodiment of the present disclosure.

FIG. 19A shows a perspective view of a single-use transfer sheet 1900 for the patient transfer device. FIG. 19B shows a bottom view of the single-use transfer sheet 1900, according to another exemplary embodiment.

The single-use transfer sheet 1900 is similar to the single-use transfer sheet 700. The transfer sheet 1900 also includes a second strip of adhesive 1910 that can be uncovered and used during the initial loading of the transfer sheet 700 onto the patient transfer device or at a later time as needed. The second strip of adhesive may not be used at all by some embodiments.

Figure 20A:
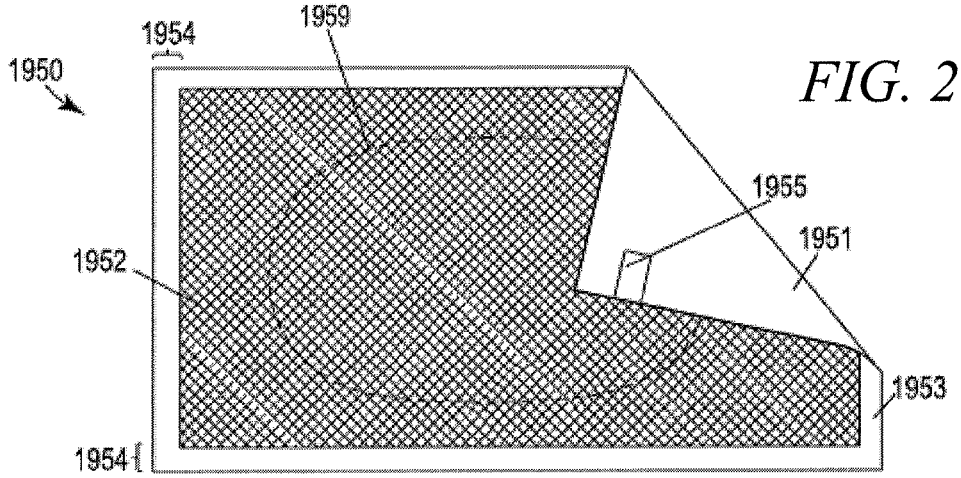
FIG. 20A is a top view showing an alternate configuration for the transfer sheet, according to a further embodiment of the present disclosure.

FIG. 20A is a top view of a transfer sheet 1950, according to a further embodiment. In this example, transfer sheet 1950 is formed of a bottom layer or backing 1951, middle absorbent layer 1952, and upper permeable (e.g., top) layer 1953.

Bottom or backing layer 1951 is formed of a structural material such as a strong, durable polymer, which may be relatively impervious to fluid flow. Bottom or backing layer 1951 may also include or be formed of a structurally reinforcing material, for example an additional layer of non-woven polymer, or a spun, flash-spun, or woven layer of a fiber material such as a polyamide, aramid, para-aramid, or polyethylene fiber material that is resistant to tearing, such as a nylon, KEVLAR or TYVEK material, or a substantial structural or generic equivalent thereof.

In some embodiments, bottom layer 1951 also includes one or more coatings or impregnated materials selected for permeability or impermeability to water and/or fluid transport. In additional embodiments, bottom layer 1951 includes one or more coatings or impregnated materials selected for other properties such as increased or reduced friction, for example a silicone impregnated nylon or other impregnated material.

Middle or absorbent layer 1952 is formed of one or more absorbent materials provided between bottom layer 1951 and top layer 1953, such as absorbent cloth or textile materials, absorbent or super absorbent polymer materials, and combinations thereof. As shown in FIG. 20A, absorbent layer 1952 may also have a somewhat smaller surface area than one or both of bottom layer 1951 and top layer 1953, with absorbent layer 1952 positioned inside an exterior or border region 1954 in which bottom and top layers 1951 and 1953 are provided in direct contact; for example with no middle or absorbent layer 1952 therebetween.

Top layer 1953 may be formed of a relatively permeable material such as a permeable polymer or permeable textile material, or a relatively impermeable material polymer or textile material configured with a plurality of apertures or microapertures. In particular, the materials of top layer 1953 may be selected to enable the transport of fluids including liquids through top layer 1953 of transfer sheet 1950 to middle or absorbent layer 1952 of transfer sheet.

In some applications, transfer sheet 1950 may be provided in sterile form, for example in a burn unit or intensive care unit (ICU) environment, where the infection risk is elevated. In sterile applications top layer 1951 may include a removable cover sheet, which can be used to protect the sterile surface of the transfer sheet prior to use. An antibiotic or antimicrobial material can also be included, for example with silver nitrate impregnated into one or more of layers 1951, 1952 and 1953.

Advanced absorbent materials can also be used to provide additional capacity for specific applications. Sheet qualities may be signaled by a visual cue, for example, color-coded (e.g., green) sheets may signal absorbency suitable for standard catheter laboratory and operating room procedures, and (e.g., pink) sheets may signal absorbency suitable for obstetrics, and other applications where fluid absorption or another attribute is a design consideration. The fluid absorption capacity of a single-use transfer sheet may range up to about a liter (or about 35 ounces) for "standard" applications, e.g., about 800 ml (or about 27 ounces), and up to 1.5 liter (about 50 ounces) or more for "ultra" or "super" absorbent applications, e.g., about 1.6 liter (or about 54 ounces). Additional absorptive material may also be provided in a selected area of the transfer sheet, e.g., a selected central area 1959.

The various layers 1951, 1952, 1953, etc. of transfer sheet 1950 may be bonded together via one or more chemical, mechanical, or thermal processes, for example using a heat seal or thermal bonding technique. In a thermal bonded configuration, the thermal bonding pattern may be configured to discourage delamination and tearing during use of transfer sheet 1950, for example with a thermal bonding pattern or grid spacing ranging from about one inch or less (≤2.54 cm), to about one centimeter or less (≤0.39 inch).

Figure 20B:
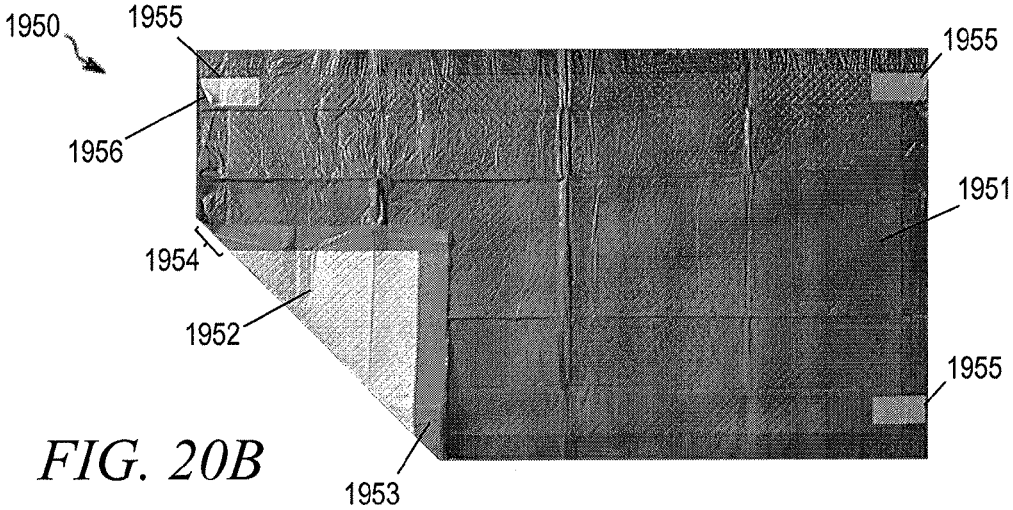
FIG. 20B is a bottom view of the transfer sheet, according to the embodiment of FIG. 20A.

FIG. 20B is a bottom view of transfer sheet 1950 as shown in FIG. 20A. As shown in FIG. 20B, bottom layer 1951 of transfer sheet 1950 may be provided with one or more adhesive strips or tabs 1955 positioned along the ends or edges of transfer sheet 1950, for example with an adhesive to removably attach transfer sheet 20A to the continuous belt of a patient transfer device, as described herein.

In some applications, adhesive strips or tabs 1955 may be provided with a tab cover 1956, for example in a peel- and stick arrangement with a non-adhesive-backed paper material which can be removed to expose the adhesive prior to use. In these examples, cover tabs 1956 may be larger in dimension than adhesive strip 1955, so that a portion of each cover tab 1956 extends over and out past (beyond) the surface area of adhesive strip 1955 for ease of manipulation and removal, for example when manipulated by care providers wearing gloves.

Figure 20C:
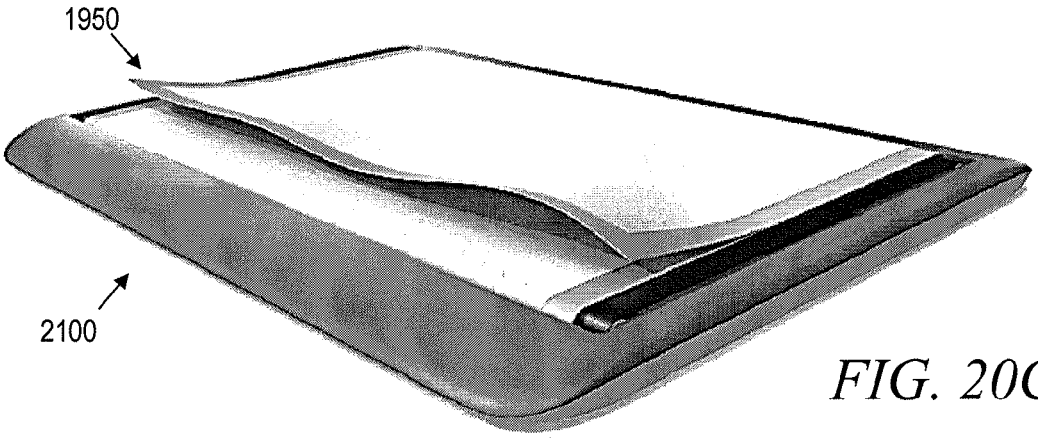
FIG. 20C is a perspective view of a transfer sheet loaded onto the patient transfer device.

FIG. 20C is a perspective view of a single-use transfer sheet 1950 loaded onto a patient transfer device to form patient transfer system or apparatus 2100, for example utilizing device 300 or 1800 as described above, or in the form of system 2100 as further described below. Alternatively, a different embodiment of transfer sheet 1950 may be utilized, for example transfer sheet 700 or 1900, or a multi-use transfer sheet, linen, or chucks material, as described herein.

Ergonomics

Figure 21:
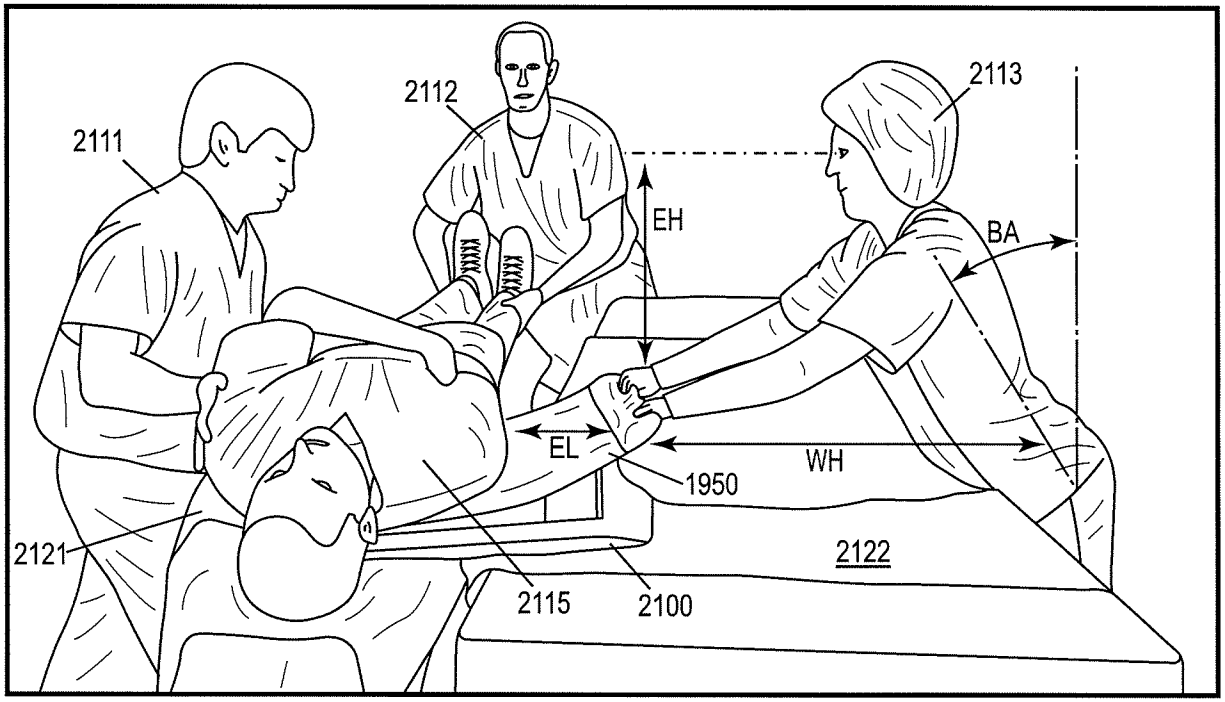
FIG. 21 is an illustration of a patient transfer device in use, according to an exemplary embodiment of the present disclosure.

FIG. 21 is an illustration of patient transfer system 2100 in use, according to an exemplary embodiment of the present disclosure. In this particular example, a number of health care workers 2111, 2112, 2113, etc. may utilize device 2100 to transfer or transport a patient or other body 2115 from a first (starting) surface 2121 to a second (destination) surface 2122, for example from an operating table or laboratory or examining station to a bed or gurney, as shown in FIG. 21.

Alternatively, device 2100 may be utilized to transfer a patient 2115 or other body from any suitable surface 2121 to any other suitable surface 2122, for example any of a bed, table, or station in a hospital, clinical, home care or patient transportation environment. In each of these applications, the number of care workers 2111-2113 may vary, for example, an additional care worker may be stationed at the head of patient 2115, or there may be fewer (or more) care workers 2111-2113.

FIG. 21 illustrates a number of features of the patient transfer device (or patient transport system) 2100, when used in combination with a single-use or multiple-use transfer sheet 1950. In contrast to roller boards and other existing systems, for example, patient transfer device remains substantially stationary during the transfer process, lowering the risk of cross-contamination from first surface 2121 to second surface 2122, and reducing the number of required patient manipulations, as described above.

In addition, transfer device 2100 provides substantially more uniform support to patient 2115 during the transfer process, with substantially less friction, increasing patient comfort and reducing the risk of strain on health care workers 2111-2113. For example, transfer sheet 1950 may have an extended length EL when loaded onto device 2100, as defined between the body of patient 2115 on first (initial) surface 2121, and the edge or border region of sheet 1950, where it is grasped by health care worker 2113. Where health care worker 2113 is located on the opposite side of device 2100, across (or on) destination surface 2122, this configuration of system 2100 with transfer sheet 1950 can decrease strain by reducing back angle BA, as defined between vertical and a line between the hip and shoulder of health care worker 2113, as shown in FIG. 21.

The particular sheet dimensions and usage configurations for system 2100 may vary, depending on application. For example, in one embodiment transfer sheet 1950 may extend for length EL of about twelve to twenty-four inches (or about 30 to about 60 cm) when loaded onto device 2100, as defined from the side of patient 2115 on initial surface 2121 to the edge of transfer sheet 1950, where it is grasped by health care worker 2113 on the side of second (destination) surface 2122. Especially for relatively small-statured health care workers 2113, this may reduce back angle BA substantially as compared to other transfer and transport systems, for example to a range of about 30 degrees or less, or about 45 degrees or less. Extension length EL of transfer sheet 1950 can also be selected for other ergonomic variables, for example in order to reduce wrist-hip distance WH, or to increase eye-hand distance EH.

These configurations of patient transfer system 2100 can provide substantial ergonomic benefits for health care workers 2113, including increased ease of patient transfer with reduced risk of injury due to stress and strain, even for relatively large-statured, heavy or bariatric (e.g., obese) patients or bodies 2115. In contrast to other single-use and disposable linen or sheet materials, transfer sheet 1950 is also configured to provide substantial tensile strength and other structural properties, as described herein, for use in system 2100 for transferring different patients and other bodies 2115 between a range of different initial and destination surfaces 2121 and 2122.

In high-strength and reinforced configurations, for example, transfer sheet 1950 may provide a tensile strength (e.g., a grab tensile strength) of about 30-40 lbf (or about 130-180 N) or more, a bursting strength of about 85 psi (or about 600 kPa) or more, and a tear resistance (e.g., a trapped tear resistance) of about 6-9 lbf (or about 25-40 N) or more, using the materials described herein. Alternatively, transfer sheet 1950 may be provided in a heat-bonded or other multi-layer or multi-ply form, as described herein, in order to provide (for combined layers) a tensile strength of about 6-8 lbf (or about 25-35 N) or more, a bursting strength of about 20 psi (or about 140 kPa) or more, and a tear resistance of about 1-2 lbf (or about 5-10 N) or more.

This additional strength permits a health care worker positioned as the provider at 2113 to pull sheet 1950 with a force so as to overcome the frictional forces retarding patient motion onto the destination surface (although reduced by the present systems and methods), optionally with pushing from provider 2111. Specifically, the tensile strength allows a strong pulling force to be applied to the sheet edge. This allows health care provider 2113 (as seen in FIG. 21) to exert a force in the direction of desired motion, and in the direction for which the device 2100 reduces frictional resistance (e.g., parallel to the plane of bridge 2140). Thus, the device 2100 reduces the lateral force required to move the patient and the tensile strength of sheet 1950 allows a health care provider positioned to pull on sheet 1950 to apply the needed force more effectively and smoothly. In addition, participating health care providers are relieved of the need to do significant lifting of the patient's weight or other application of vertical forces (e.g., at lifting points remote from the patient's center of gravity), in order to effect the transfer.

Pull Forces

Based on conservative standards, for a given pulling distance (e.g., about six to seven feet, or about 2 m), where the starting point for the caregivers hands is between the caregiver's waist and upper chest, a single care provider can safely pull a patient weight of a particular value, in a supine to supine transfer. When a patient is transferred laterally with a draw sheet, care providers may exert a pull force of approximately 70-75% of patient weight; that is, the draw sheet system has an equivalent coefficient of friction of about 70-75%, which can be multiplied by the patient weight in order to determine whether the pull force falls within a safe or acceptable range.

For a patent weight of about 100 lbs (440-450 N), for example, the pull force needed in a draw sheet transfer is about 70-75 lbs (310-340 N). This may be enough to exceed the safe value for a single caregiver, depending on body position, pulling distance, and other factors. For other, heavier patients, the required pull forces may exceed the recommended limits for two or more caregivers in typical draw sheet transfer, even when working together in a coordinate fashion.

The patient transfer devices and transfer sheets described herein reduce the required pull forces by reducing (the coefficient of) friction for at least a substantial part, if not most of, the path of movement during the transfer. In particular, use of the disclosed designs show that the pull force required to execute a given transfer may be substantially reduced, as compared to draw sheet transfers and other devices, assuming the same push force is applied.

For example, a disclosed design has been used to transfer patients with weights of up to about 490-500 lbs (2150-2250 N), with BMI of up to about 53. For such larger patient transfers, there may be two pushers and one puller, in addition to staff managing the head and feet. In such cases, a greater proportion of the transfer forces can also be provided by the pushers, who may have less injury exposure due to ergonomic and physiological considerations.

Correspondingly, the transfer sheet strength may be selected to move relatively heavy patients, but with lower push and pull forces due to the transfer system design. For example, the transfer sheet may be designed to have both a minimum strength selected to meet or exceed a preselected or recommended pull force, and a breaking strength selected to act as a mechanical fuse, in order to protect the pulling caregiver when patient weight, body angle and/or other factors may result in an unsafe pull force. In particular, the materials of the transfer sheet may be selected and configured to have strength sufficient to withstand a pull of a selected minimum force, but also have a sheet yield or break limit threshold when subjected to a greater pull force.

Suitable ranges for the minimum pull strength and maximum yield or breaking strength of the transfer sheet include, but are not limited to, about 35 lbs (150-160 N), about 50 lbs (220-230 N), about 75 lbs (about 330-340 N), and about 100 lbs (about 440-450 N), about 150 lbs (660-670 N), and about 200 lbs (880-890 N), or more, and values therebetween. The maximum or yield strength is selected to be higher than the minimum pull strength, for example about twice as high or more, about three times as high or more, about five times as high or more, or about ten times as high, or more. These values can be selected so that the tensile strength of the transfer sheet is sufficient to allow for heavy patient transfers, but also selected at a level that provides a mechanical fuse or failure warning, when the transfer configuration may exceed safe pull force limits.

Additional Design Alternatives—Transfer Device

Figure 22A:
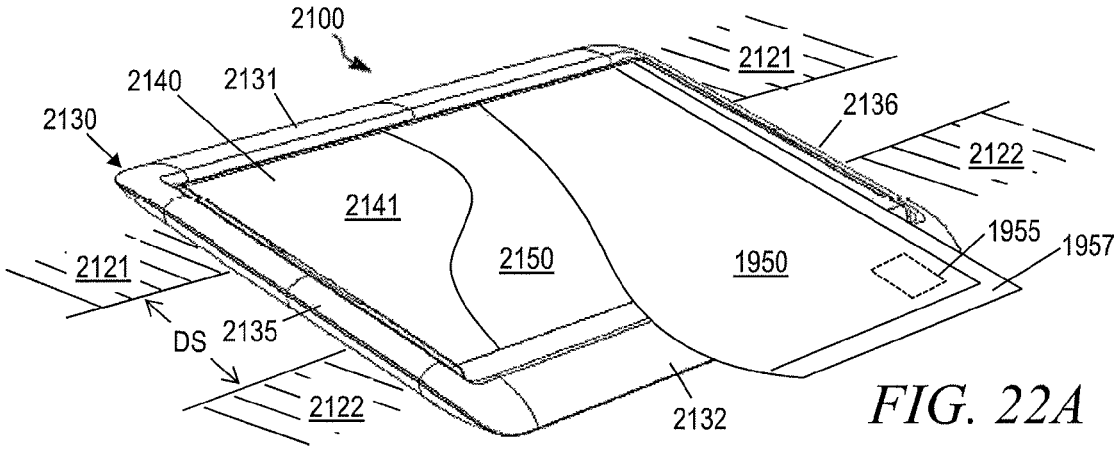
FIG. 22A is a perspective view of the patient transfer device, according to the embodiment of FIG. 21.

FIG. 22A is a perspective view of patient transfer system or device 2100, for example according to the embodiment of FIG. 21, or otherwise as described herein. In this ergonomic configuration, device 2100 includes housing 2130 formed with first and second opposing elongated sides (or elongated frame members) 2131 and 2132, and first and second opposing ends (or end caps) 2135 and 2136, respectively.

As shown in FIG. 22A, first and second opposing ends 2135 and 2136 of housing 2130 are dimensioned for housing 2130 to span a gap distance DS between first surface 2121, at or proximate first side 2131 of housing 2130, and second surface 2122, at or proximate second side 2132 of housing 2130. A support deck or bridge 2140 is positioned at least partially or fully within housing 2130, and configured to support a patient or other body during transfer from first side 2131 of housing 2130 and across support bridge (or bridge support) 2140 to second side 2132 of housing 2130.

Bridge 2140 is disposed at least partially within housing 2130, and coupled to first and second end caps 2135 and 2136 or other members that transfer weight on bridge 2140 to first and second opposing elongated sides (or elongated frame members) 2131 and 2132. Bridge 2140 can be provided in a roller or roller-less design, and with or without a continuous transfer belt 2150, as described herein.

As shown in FIG. 22A, for example, support bridge 2140 is spaced between first and second sides 2131 and 2132 of housing 2130, defining a channel or pathway through housing 2130 for transfer belt 2150. Depending on configuration, transfer belt 2150 may be formed of a strong, flexible material such as a polymerized fabric, and provided in a conveying relationship about or encircling bridge 2140. The channel may extend, for example, from a first opening proximate first side 2131 of housing 2130, continuing below bridge 2140 and between bridge 2140 and the bottom of housing 2130, then to a second opening proximate second side 2132 of housing 2130 (see, e.g., FIGS. 24A-24C).

The bottom of housing 2130 extends between first and second ends (or end caps) 2135 and 2136, spanning distance DS between first and second surfaces 2121 and 2122, with first side 2131 supported on first surface 2121 and second side 2132 supported on second surface 2122. This configuration spaces support deck or bridge 2140 and transfer belt 2150 from surfaces 2121 and 2122 while allowing weight on the bridge 2140 to be transferred to these surfaces. Thus, transfer belt 2150 (and any transfer sheet material) can move with the patient from first side 2131 of housing 2130 toward second side 2132, while housing 2130 and device 2100 remains substantially stationary with respect to first and second surfaces 2121, and without contact between transfer belt 2150 or support bridge 2140 and either of surfaces 2121 and 2122.

During the transfer process, the weight of the patient is supported by bridge 2140, for example with vertical (gravitational) loading transferred from the patient body through one or both of transfer belt sheet 1950 and belt 2150, onto top support surface 2141 of bridge 2140. Support deck or bridge 2140 and transfer belt 2150 are isolated from first and second surfaces 2121 and 2122 by the bottom of housing 2130, and by first side 2131 and second side 2132 of device 2100, respectively, but may transfer weight to these surfaces via the structure housing 2130. Similarly, where a transfer sheet 1950 or other material is used, the transfer sheet is spaced from (that is, does not contact) first (initial) surface 2121, reducing the risk of cross-contamination by transport of bedding and other unnecessary materials from first surface 2121 to second surface 2122. This "spaced" or "isolated" patient transfer configuration also reduces the number of manipulations required in each patient transfer, as compared to other devices, and as described herein.

These various embodiments have in common removing the need to lift a patient's full weight in favor of placing the patient on a sheet 1950 that is supported so as to be relatively easily moved with the patient on it. In general, to allow attending providers to perform a transfer, the device and sheet together offer a transfer motion that involves little friction, notwithstanding patient weight. However, if too little friction may mean reduced control of the motion of the patient, particularly if the device 2100 were angled downward toward a destination surface and a patient might gain too much momentum, the device may be equipped with a braking component that can provide or selectively apply friction that allows greater motion control. For example, an adjustable pad may apply a greater of lesser level of friction to continuous belt 2150. Providing for such control may reduce jostling that may cause patient discomfort.

Note that the designations of first and second sides 2131 and 2132 of housing 2130 are arbitrary, as are the designations of first and second ends 2135 and 2136, and first and second surfaces 2121 and 2122. Thus, any or all of these designations may be interchanged or reversed, without loss of generality. For example, support bridge 2140 and belt 2150 may be configured to transfer a patient in either direction, from first side 2131 to second side 2132 of device housing 2130, or from second side 2132 to first side 2131. Housing 2130 of transfer device 2100 can also be rotated in either a horizontal or vertical plane, or both, for example to exchange the respective locations of first and second sides 2131 and 2132 with respect to first and second surfaces 2121 and 2122, and/or to exchange the locations of first and second ends (or end caps) 2135 and 2136.

As shown in FIG. 22A, transfer sheet 1950 extends from the channel opening adjacent first side 2131 of housing 2130, and wraps around top surface 2141 of support bridge 2140. This may be accomplished, for example, by using adhesive strips or tabs 1955 to attach sheet 1950 to transfer belt 2150, as described above, and then translating continuous belt 2150 from second side 2132 of housing 2130 toward first side 2131, in order to load transfer sheet 1950 onto belt 2150 and into housing 2130 of patient transfer device 2100.

After loading, the exposed end 1957 of transfer sheet 1950 extends from housing 2130 and over top surface 2141 of support bridge 2140 on continuous belt 2150, as shown in FIG. 22A. An additional adhesive strip 1955 may be used to attach the exposed end 1957 of transfer sheet 1950 to device 2100 until ready for use, for example by attaching adhesive strip 1955 to the outer surface of belt 2150, or to side 2132 of housing 2130. Alternatively, a transfer sheet 1950 or other transfer material may be loaded directly into device 2100 by wrapping the material around support deck 2140 without using a continuous belt 2150, as described herein. In these embodiments, an adhesive 1955 may still be provided for use on exposed end 1957 of transfer sheet 1950, or no adhesive strips 1955 may be provided.

Figure 22B:
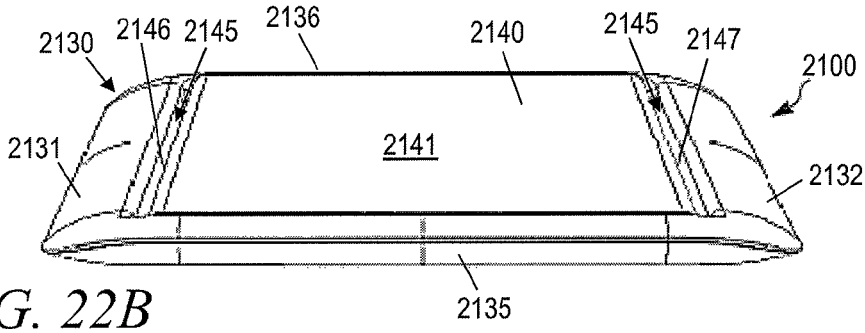
FIG. 22B is an end view of the patient transfer device, according to the embodiment of FIG. 21.

FIG. 22B is an end view of patient transfer device 2100, shown without transfer belt 2150 or sheet 1950. First side 2131 of housing 2130 is formed by an elongated frame member oriented toward the left of the drawing, and second side 2132 is formed by an elongated frame member oriented toward the right of the drawing, opposite first side 2131. First end cap 2135 is oriented toward the front of the drawing, and second end cap 2136 is oriented at the back, opposite first end cap 2135.

As shown in FIG. 22B, channel 2145 has first opening 2146 defined between top surface 2141 of support bridge 2140 and first side 2131 of housing 2130, with second opening 2147 defined between top surface 2141 of bridge 2140 and second side 2132 of housing 2130. Openings 2146 and 2147 of channel 2145 space bridge 2140 between first and second sides 2131 and 2132 of housing 2130, with channel 2145 extending under bridge 2140 to accommodate the transfer belt and/or for loading a transfer sheet, as described above.

Positioning Features

Figure 22C:
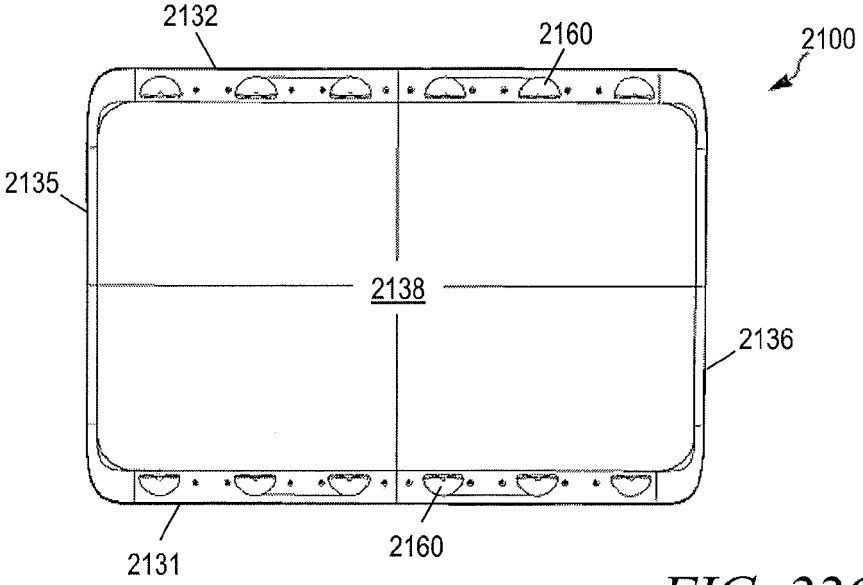
FIG. 22C is a bottom view of the patient transfer device, according to the embodiment of FIG. 21.

FIG. 22C is a bottom view of the patient transfer device 2100, presenting bottom surface 2138 of housing 2130 with first end 2135 oriented toward the left of the drawing and second end 2136 oriented toward the right. In this example, transfer device 2100 is provided with a plurality of feet or other positioning features 2160 along its edges. For example, feet 2160 may be a high friction material (e.g., rubber or similar elastomer), and arranged in two rows along opposite sides 2131 and 2132 of housing 2130, in order to hold housing 2130 of device 2100 substantially stationary during transfer of a patient from one surface to another, as described herein.

Figure 23A:
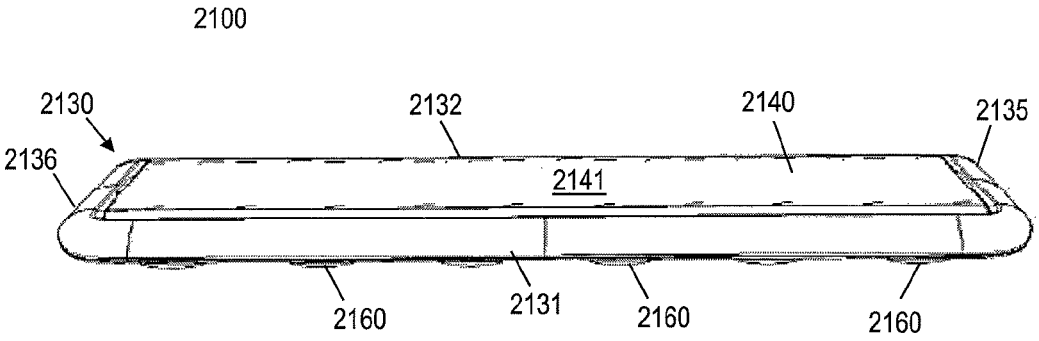
FIG. 23A is a profile view of the patient transfer device, illustrating the positioning surfaces or feet.

FIG. 23A is a profile view of patient transfer device 2100, illustrating the positioning of non-skid features or feet 2160. In the rotated orientation of FIG. 23A, first end 2135 of housing is positioned to the right, and second end 2136 is positioned to the left, with first side 2131 of housing 2130 in front and second side 2132 in back. A plurality of six feet 2160 is arranged in a row along first side 2131 of housing 2130. An additional row of feet 2160 may be similarly arranged along second side 2132, opposite the row of feet 2160 on first side 2131, for example as shown in FIG. 22C. Alternatively, there may be more or fewer individual features 2160 in each row, for example two, three, or a different number, or a single extended positioning feature 2160 may be used, extending along each of side 2131 and side 2132, respectively.

Figure 23B:
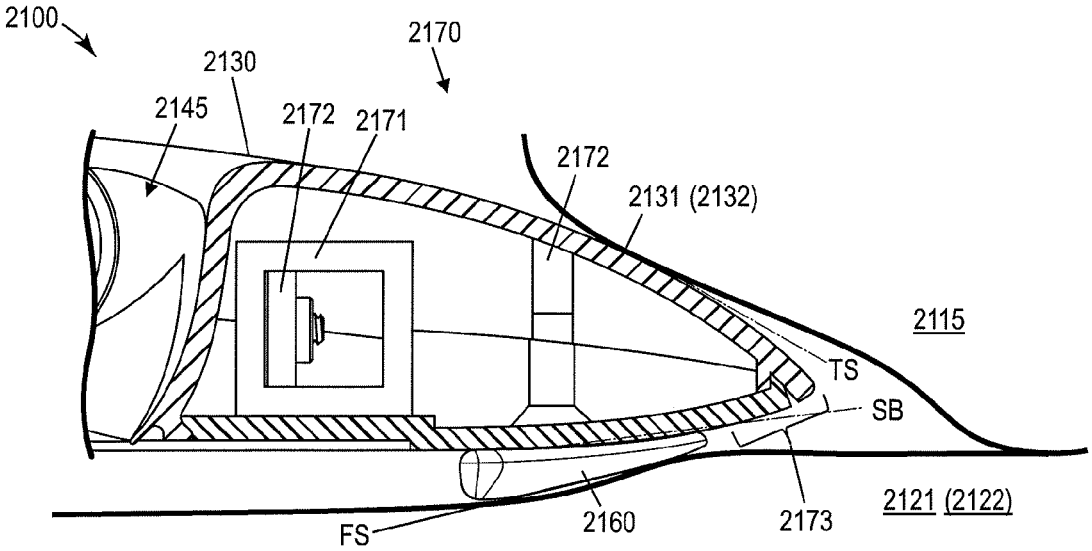
FIG. 23B is a detail view of the patient transfer device, illustrating the sloped side transition and contoured edge configuration.

FIG. 23B is a detail view of patient transfer device 2100, illustrating the sloped side transition and contoured edge configuration. In FIG. 23B, side 2131 of housing 2130 is formed with a sloped transition or contoured edge region 2170, for example including an elongated internal frame member 2171 attached with one or more bolts, screws or other mechanical fasteners 2172. Positioning elements or feet 2160 may be attached to the bottom of contoured edge region 2170 via mechanical fasteners 2172, or using an adhesive or a chemical or thermal bond.

As shown in FIG. 23B, positioning elements or feet 2160 can be provided in a contoured region 2170 along one or both of first side 2131 and second side 2132 of housing 2130, adjacent first (initial) surface 2121 or second (destination) surface 2122. Contoured region 2170 is configured with gradually increasing top slope TS and bottom (or base) slope SB, converging toward outside edge 2173 of housing 2130. This provides the side of housing 2130 with a decreasing thickness or height profile, with converging top and bottom slopes TS and SB selected for increased patient comfort, decreased resistance, and improved ergonomics while positioning transfer device 2100 between the patient (or other body) 2115 and surface 2121 (or 2122), while transferring body 2115 from first surface 2121 onto device 2100, and while transferring body 2115 from device 2100 onto second surface 2122.

Feet 2160 may be formed of a rubberized plastic or other material selected to position housing 2130 on surface 2121 (or 2122), and to hold patient transfer device 2100 substantially stationary with respect to the surface during transport of patient 2115. In particular, the material of feet 2160 can be selected for non-skid performance or increased friction along the bedding or other material forming surface 2121, as compared to the bottom and side surfaces of housing 2130.

Thus, in normal operation device 2100 does not travel with the patient (or other body) during the transfer process, as in some other (e.g., roller board) designs. It is nonetheless recognized that some vertical motion of device 2100 may occur during transfer of body 2115, for example on bedding or other resilient surfaces 2121. In addition, some slippage of feet 2160 and/or sides 2131, 2132 of housing 2130 may also occur, for example over bed linens and other loose materials, or even over a smooth surface such as metal or plastic.

The term "substantially stationary," therefore, as used with respect to device 2100 and housing 2130 herein, indicates that at least a portion of first side 2131 of housing 2130 remains in contact with first surface 2121 during normal operation of device 2100; that is, during the patient transfer process (e.g., assuming surfaces 21212, 2122 are not greatly different in height), until device 2100 and housing 2130 are manually repositioned. Likewise, the second (opposite) side 2132 may maintain similar contact with the second (destination) surface 2122 during the patient transfer process, until device 2100 and housing 2130 are repositioned. The portions of device 2100 in contact with the respective initial and final surfaces may include, but are not limited to, one or more sides of housing 2130 (e.g., side 2131 and/or side 2132), any contoured region 2170 along the side of housing 2130, and any one or more feet or other positioning features 2160. The positioning features as disposed along a bottom surface of at least one contoured edge region are configured to hold the transfer apparatus substantially stationary with respect to at least one of the first and second surfaces in transfer of a patient.

Alternative Bridge Designs

Positioning features (feet) 2160 may also have a sloped or beveled surface, for example with converging slope FS as shown in FIG. 23B. These various slopes TS, SB and FS in contoured region 2170 of housing 2130 allow device 2100 to be tilted up and down for easier insertion and removal, for example by sliding outside edge 2173 of housing 2130 along surface 2121 (or 2122), close to the patient body 2115, and then tilting housing 2130 down toward surface 2121 (or 2122) to increase contact between feet 2160 and surface 2121. For removal, housing 2130 of device 2100 can be tilted back up, away from surface 2121 (or 2122), sliding outside edge 2173 away from patient or body 2115 along surface 2121 (or 2122).

Figure 24A:
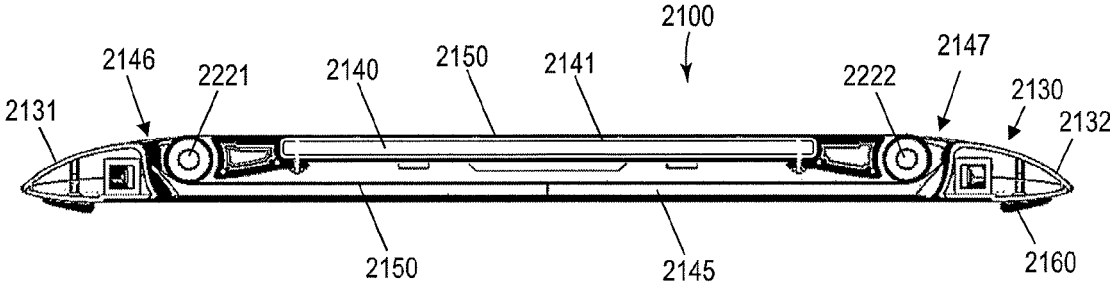
FIG. 24A is a cross-sectional end view of the transfer device, in a roller bridge embodiment.

FIG. 24A is a cross-sectional end view of transfer device 2100, in a roller bridge embodiment. In this configuration, support deck or bridge 2140 includes first and second elongated rollers 2221 and 2222, positioned adjacent openings 2146 and 2147 of channel 2145, and along first and second elongated sides (or side members) 2131 and 2132 of housing 2130, respectively.

Continuous transfer belt 2150 is positioned in conveying relationship about support bridge 2140 and rollers 2221 and 2222, in order to transfer a patient or other body from first side 2131 of housing 2130 toward second side 2132, or from second side 2132 of housing 2130 toward first side 2131. Thus, the body moves in conveying relationship with transfer belt 2150 (and any transfer sheet 1950), from first side 2131 of housing 2130 (at or proximate first surface 2121) and across support bridge 2140 to second side 2132 of housing 2130 (at or proximate second surface 2122).

Top surface 2141 of bridge 2140 may be coated in order to reduce friction with moving belt 2150, or another reduced friction surface may be used. Suitable coating and surface finishing techniques for reduced friction surfaces include, but are not limited to, powder coating (e.g., a free-flowing, dry powder coating technique), textured surface applications, film coating, vapor deposition, spraying, and other coating and surfacing techniques selected for reduced friction, durability and other properties, as described herein. Transfer belt 2150 may also be provided with a reduced friction (e.g., inner) surface or layer, for example a silicone impregnated nylon or other material, which is selected to reduce friction along the interface between transfer belt 2150 and the facing (e.g., top) support surface 2141, and other areas of contact with support bridge 2140.

In powder coated and other reduced-friction surfaces, the reduction in the friction coefficient may result from a combination of coating materials and texture, e.g., an "orange peel" texture or other irregular texture that reduces the surface area of contact between the top surface of the bridge and the bottom surface of the belt or sheet. Alternatively, a smooth or textured surface may be provided with a different coating material, for example a synthetic resin coating such as a TEFLON coating or a silicone coating material.

With respect to powder coating, there are two coating categories: thermosets and thermoplastics. The thermosetting variety of powder coating material incorporates a cross-linker into the formulation. When the powder is baked, the cross-linker reacts with other chemical groups in the powder to polymerize, improving performance properties. The thermoplastic variety does not undergo additional actions during the baking process, but rather flows out into the final coating.

Suitable polymers used in the disclosed coatings may include, but are not limited to, polyester, polyurethane, acrylics, polyester-epoxy (or hybrid) materials, and "straight" or substantially epoxy materials (e.g., a fusion bonded epoxy material). In production of the powder coating, granules of the selected polymer(s) are mixed with hardener, pigments and other powder ingredients. The mixture is heated in an extruder, rolled flat, cooled and broken into small chips which are milled and sieved to make a fine powder, for application to the selected surfaces of the device.

More generally, the low coefficient of friction for the powder coated surface results from a combination of the powder coated material itself, and the hardness, gloss level, size and physical geometry of the texture. A variety of versatile polymers such as polyester can be used for the coating material, and may be formulated with physical properties selected to produce durable, tough, strong, and resilient coated surfaces. The hardness also contributes to the "slipperiness" of the coating, in that it resists deforming when force is applied, helping to keep the amount of surface area contact lower.

The high points of the hard textured surface act like small ball bearings, as opposed to more compliant or pliable materials like rubber. The textured geometry also has an effect, as it interacts with the belt or sheet material sliding across it. If the texture pattern is too similar to the surface sliding across it, for example, the peaks and valleys can align and "lock" together for an instant, increasing friction and drag forces.

The gloss level of the finish also contributes. If a surface has more of a matte finish, at a microscopic level the particles refract light in all directions because of the misalignment of the particles on the surface, which can also cause an increase in friction. A more "glossy" surface, on the other hand, will be more uniform at a microscopic level, producing a smoother surface and reflecting light in a more uniform manner. This type of surface will not resist material sliding across it as much as a matte surface would.

The same principles can also be applied to the belt and sheet materials, and how they interact with the powder coated (or other friction coated) surface. For fiber materials, in particular, the "hardness," diameter, weave pattern, stiffness, etc. can be selected for friction properties, so that the sheet or belt slides across the textured powder coated surface with reduced drag forces and energy loss, when operated in the disclosed patient transfer systems.

Figure 24B:
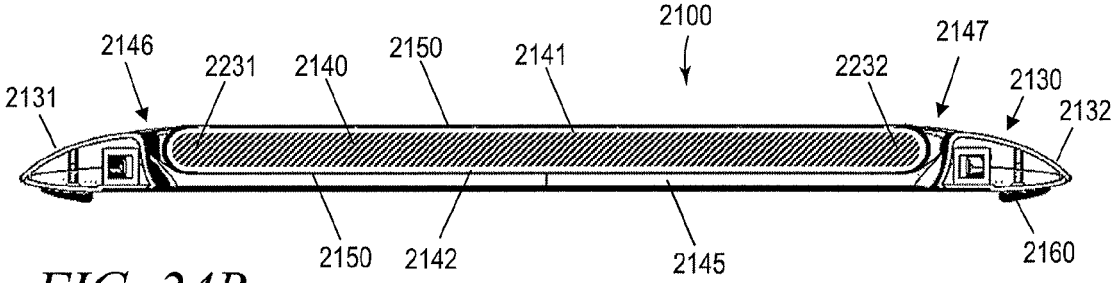
FIG. 24B is a cross-sectional end view of the transfer device, in a roller-less bridge embodiment.

FIG. 24B is a cross-sectional end view of transfer device 2100, in a roller-less bridge embodiment. In this configuration, support deck or bridge 2140 may have a substantially unitary construction, with elongated, contoured end members 2231 and 2232 in place of rollers 2221, 2222, as shown in FIG. 24A. In this roller-less or "solid state" configuration, support bridge 2140 may have no or substantially no moving (i.e., conveying) parts during the transfer operation, in order to reduce weight and increase service life and durability. To reduce friction with respect to motion of transport belt 2150, the surfaces of bridge 2140 that contact belt 2150 may be powder coated, or have another coating or surface treatment selected to reduce friction. The coated surfaces may include, for example, not only top surface 2141 of bridge 2140, but also bottom surface 2142, as well as the outer surfaces of contoured end members 2231 and 2232.

Figure 24C:
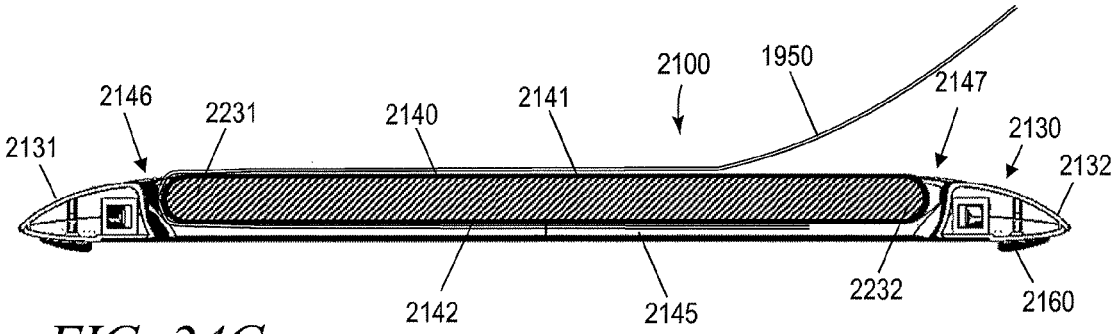
FIG. 24C is a cross-sectional end view of the transfer device, in a beltless bridge embodiment.

FIG. 24C is a cross-sectional end view of transfer device 2100, in a beltless embodiment. In this example, support bridge 2140 is provided in "solid state" or roller-less form, with substantially no moving parts as described above, and without transfer belt 2150 as shown in FIGS. 24A and 24B. Instead, a transfer sheet 1950 or other material may be inserted directly into channel 2145, for example extending from opening 2146 and wrapping around support bridge 2140 as shown in FIG. 25C. Alternatively, the transfer sheet 1950 may be pulled from a pocket into which a folded or rolled sheet is placed with a portion extending or therefrom, e.g., a multi-sheet dispensing cartridge (see FIGS. 27A-27C) located on the side of the device 2100 that is placed under the patient before moving.

In this embodiment, transfer sheet 1950 is positioned in direct contact with support bridge 2140; for example, the bottom surface or layer of transfer sheet 1950 and top surface 2141 of bridge 2140, and/or any one or more of bottom surface 2142 of bridge 2140 and the outer surfaces of contoured end members 2231 and 2232 may be in planar contact. Powder coating or another surface coating or finishing technique can be used on any or all of these device surfaces to reduce friction, as described above. In addition, transfer sheet 1950 may be provided with a compatibly low friction bottom layer, e.g., a silicone impregnated fabric or film coating, or other reduced friction material.

A bottom surface of the bottom layer of such a transfer sheet 1950, opposite the absorbent layer and the permeable layer, may comprise a low friction material matched or coordinated with a low friction adjacent surface of the support bridge 2140, and the layers of the transfer sheet may have sufficient tensile strength to allow a patient supported on the sheet 1950 to be pulled across the low friction adjacent surface of the support bridge 2140 of the patient transfer device. Such a transfer sheet 1950 may not typically require adhesive strips or tabs for a belt attachment. For situations where greater control over the motion of a transferred patient is desired (such as if the device 2100 were angled downward toward a destination surface and a patient might gain too much momentum) sheet 1950 may be selected with a low friction bottom layer that affords some friction when it slides across bridge 2140.

Figure 25A:
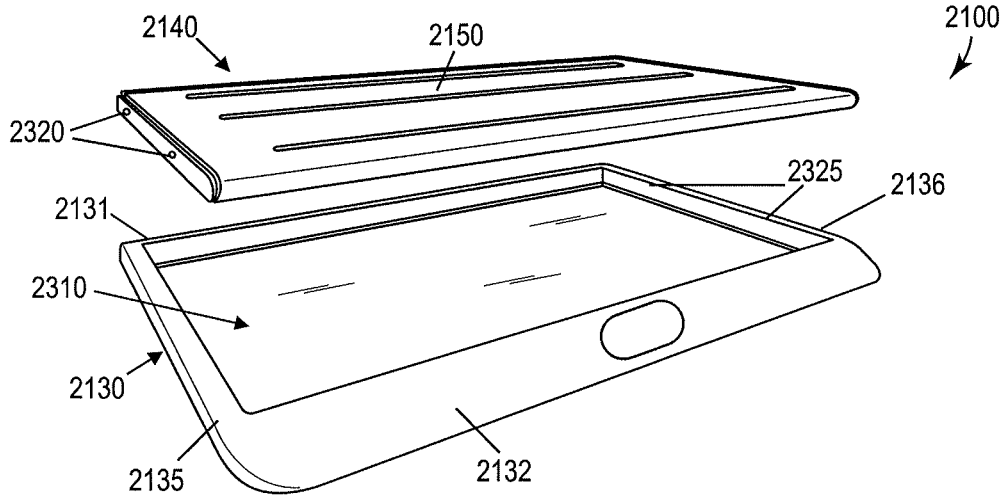
FIG. 25A is a perspective view of the patient transfer device, with the bridge removed.

FIG. 25A is a perspective view of patient transfer device 2100, with support bridge 2140 and transfer belt 2150 removed. In this configuration, bridge 2140 is removable and replaceable within cavity 2310 of device housing 2130, for example using spring biased pins or other release mechanisms 2320, which are received into corresponding indents or holes 2330 in ends 2135 and 2136 of housing 2130, facing the inside of bridge cavity 2310.

As shown in FIG. 25A, pins 2320 and corresponding holes or indents 2325 can be configured to couple support bridge 2140 to ends 2135 and 2136 of housing 2130, with transfer belt 2150 positioned in conveying relationship about bridge 2140, and spaced between opposite sides 2131 and 2132 of device 2100, as described above. Pins or release mechanisms 2320 and the corresponding holes or indents 2325 can also be keyed so that bridge 2140 is only received one way within housing 2130, or to prevent rotation or inversion of bridge 2140 within bridge cavity 2310. Alternatively, bridge 2140 may have a symmetric design, and pins 2320 and indents 2325 may be configured to accept bridge 2140 in a variety of different orientations with respect to housing 2130 and bridge cavity 2310.

Figure 25B:
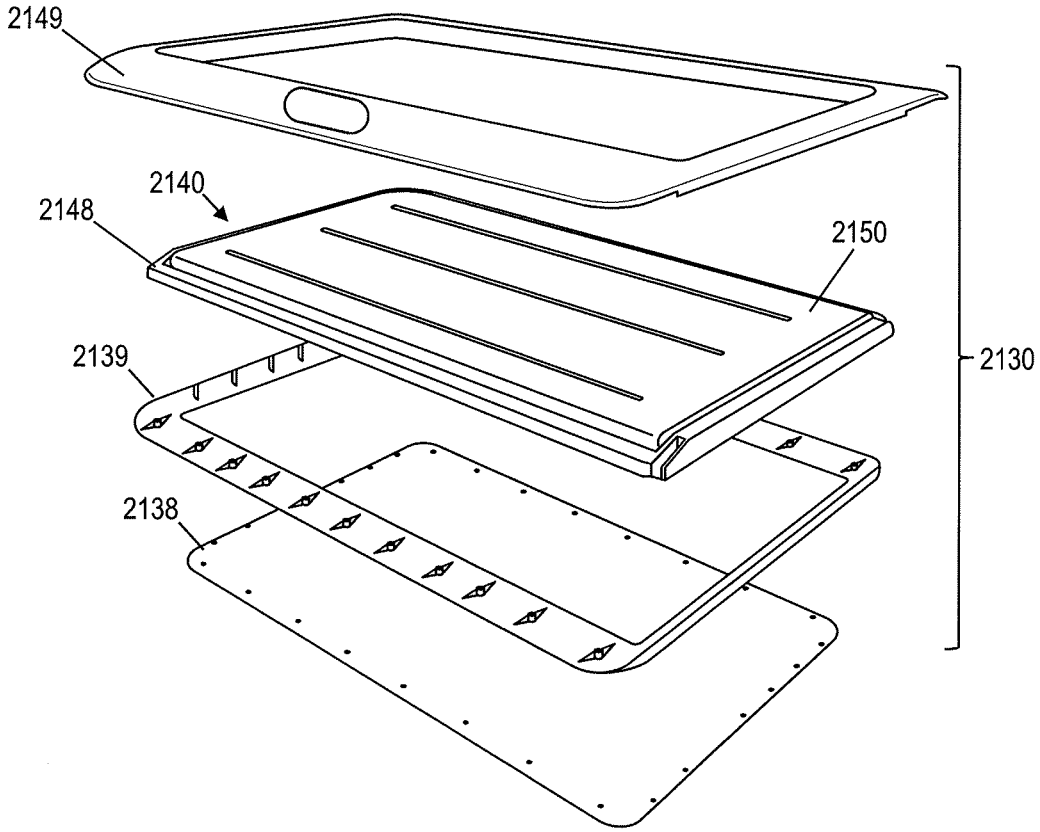
FIG. 25B is an exploded view of the patient transfer device, according to the embodiment of FIG. 25A.

FIG. 25B is an exploded view of patient transfer device 2100. In this configuration, device 2100 includes bottom housing 2138, bottom frame 2139, support bridge 2140 with bridge frame 2148 and transfer belt 2150, and top housing 2149. Frame and housing components 2138, 2139, 2148 and 2149 may be formed of plastic polymers, wood, metal, composite materials, and combinations thereof, as described above.

Bottom housing 2138, bottom frame 2139 and top housing 2149 can be coupled together to form device housing 2130 via by mechanical fastening, or by thermal or chemical bonding. Bridge frame 2148 may be configured to removably receive support bridge 2140 within housing 2130, for example using a keyed pin or other releasable locking arrangement, as described above.

Storage with Sheet Dispenser

Figure 26A:
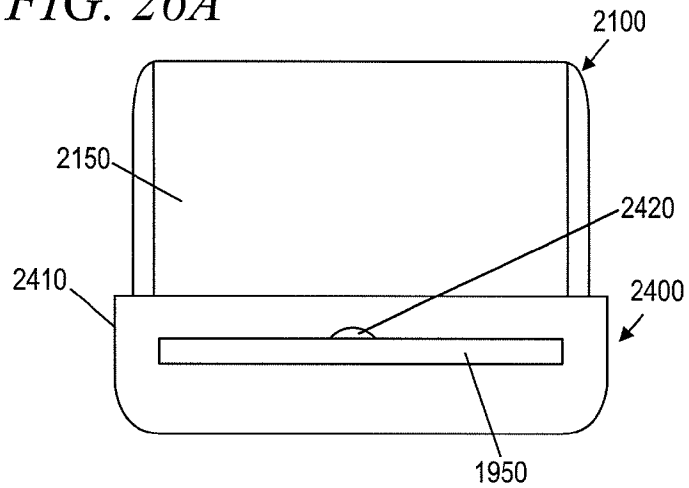
FIG. 26A is a front view of an alternate storage configuration for the patient transfer device, according to an exemplary embodiment of the present disclosure.

FIG. 26A is a front view of an alternate storage unit 2400 for transfer device 2100, for example as configurable in a wall mount or wheeled cart embodiment, as described above. In this particular example, a plurality of transfer sheets 1950 is provided in a multiple-sheet box or cartridge-type dispenser assembly 2410, with a slotted opening or other aperture 2420 for user access to individual transfer sheets 1950.

Figure 26B:
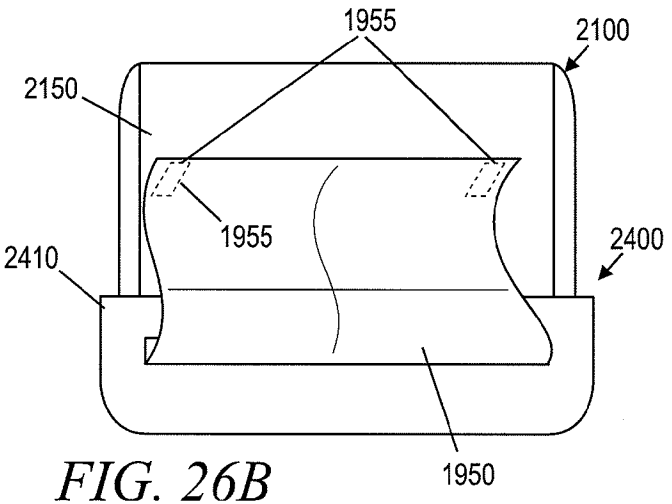
FIG. 26B is an illustration of a method for attaching a transfer sheet to the device, according to the storage configuration of FIG. 26A.

FIG. 26B is an illustration of a method for attaching transfer sheet 1950 to patient transfer device 2100. In this example, a health care worker or other user can pull the top edge or border of transfer sheet 1950 up from dispenser 2410, and attach sheet 1950 to transfer belt 2150 utilizing one or more adhesive strips or tabs 1955.

Figure 26C:
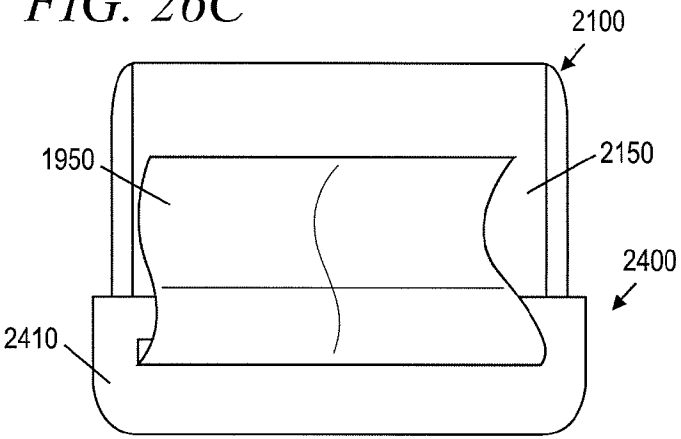
FIG. 26C is an illustration of a method for loading the transfer sheet onto the device, according to the storage configuration of FIG. 26A.

FIG. 26C is an illustration of a method for loading transfer sheet 1950 onto patient transfer device 2100. In this example, the health care worker or other user can roll transfer belt 2150 upward to feed transfer sheet 1950 into the housing of device 2100, for example via the top channel opening, as described above.

Figure 26D:
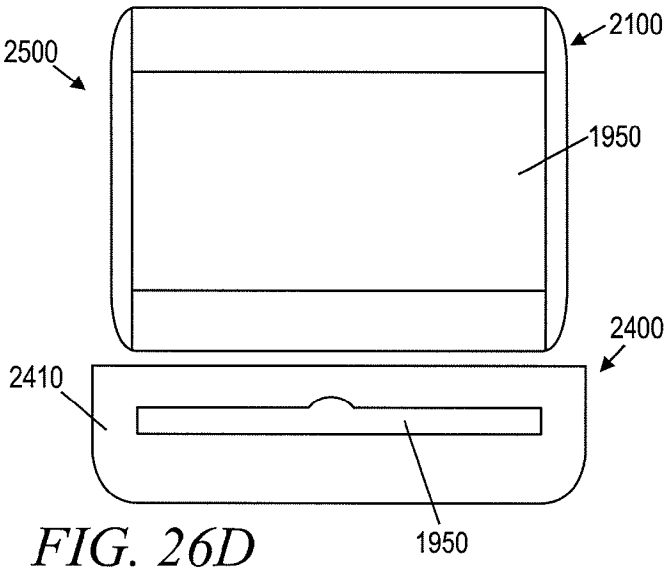
FIG. 26D is an illustration of the patient transfer device loaded with the transfer sheet, according to the storage configuration of FIG. 26A.

FIG. 26D is an illustration of patient transfer device 2100 loaded with transfer sheet 1950. After loading transfer sheet 1950, device 2100 may be removed from storage unit 2400 for use in a patient transfer operation, for example in a hospital, clinic or home care setting, or in an emergency response or transport vehicle, as described above.

Figure 27A:
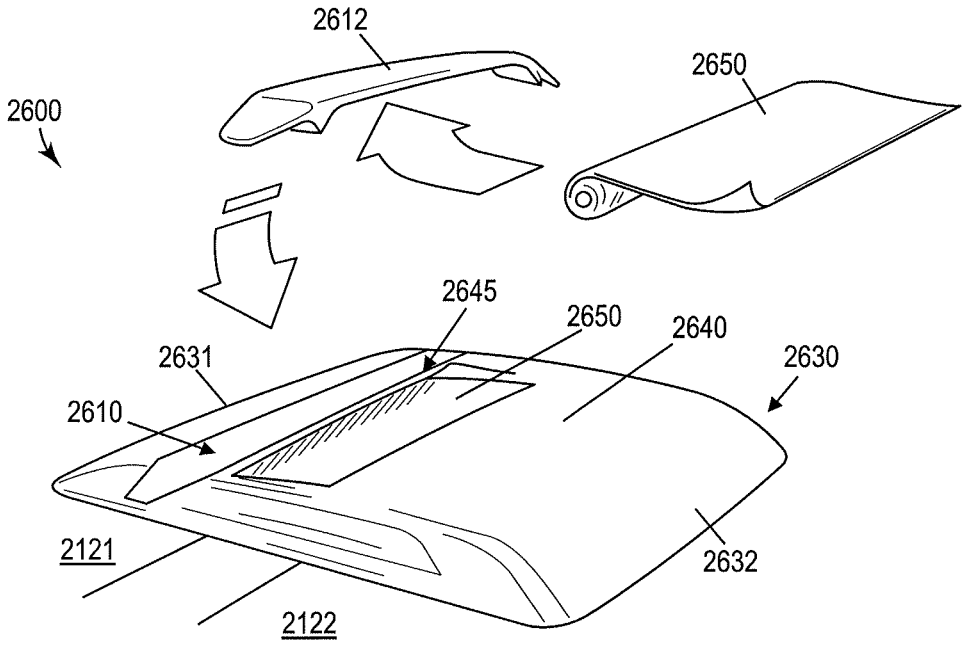
FIG. 27A is an illustration of dispenser system for the patient transfer device, according to an exemplary embodiment of the present disclosure.

FIG. 27A is an illustration of dispenser system 2610 for patient transfer device or apparatus 2600. In this example, a plurality of transfer sheets 2650 is provided within a cartridge-type dispenser system 2610. Cover 2612 of dispenser 2610 may form part of device housing 2630, with individual transfer sheets 2650 presented at opening 2645 between support bridge (or transfer deck) 2640 and first side 2631 of housing 2630. Thus, device 2650 is easily loaded for multiple patient transfers, each using a sequentially dispensed transfer sheet 2650, in a single loading process.

In other respects, device 2600 can be configured according to any of patient transfer devices 300, 1800 or 2100, as described herein. In these various embodiments, device housing 2630 spaces bridge 2640 from first and second surfaces 2121 and 2122, so that neither bridge 2640 nor the transfer belt (if used) touches either surface. This improves ergonomics and reduces the risk of cross-contamination, as described above, and device 2600 remains substantially stationary while the patient or other body is transferred from first (initial) surface 2121, at or adjacent first side 2631 of device housing 2630 to second (destination) surface 2122, at or adjacent the opposite (second) side 2632.

Figure 27B:
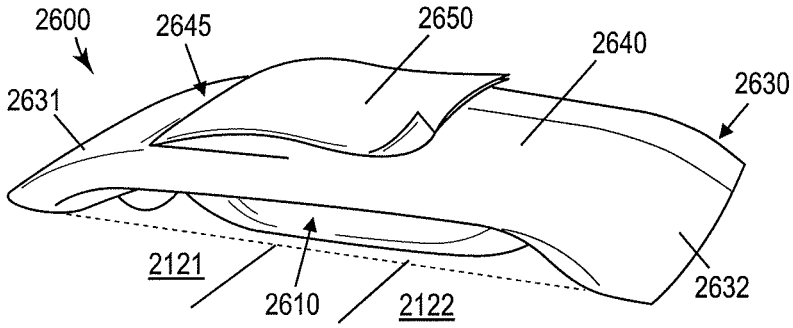
FIG. 27B is a perspective view of the device, loaded with the dispenser system.

FIG. 27B is a perspective view of patient transfer device 2600, loaded with cartridge dispenser 2610 including a plurality of transfer sheets 2650. In this configuration, the near end of device housing 2630 is shown in cutaway view, showing dispenser 2610 disposed substantially beneath the bridge or transfer deck 2640. Transfer sheet 2650 loads over bridge 2640 from opening 2645 adjacent first side 2631 of housing 2630, as described above.

Transfer sheets 2650 may be single-use articles with one or more features of transfer sheet 700, 1900 or 1950, or a single-use or multiple use linen or textile/fabric material, as described herein. Transfer sheet 2650 is isolated from first (initial) surface 2221 by housing 2630, reducing the risk of cross-contamination. Transfer sheet 2650 can also be left in place beneath the patient on second (destination) surface 2122, reducing the number of required patient manipulations, as described above.

Figure 27C:
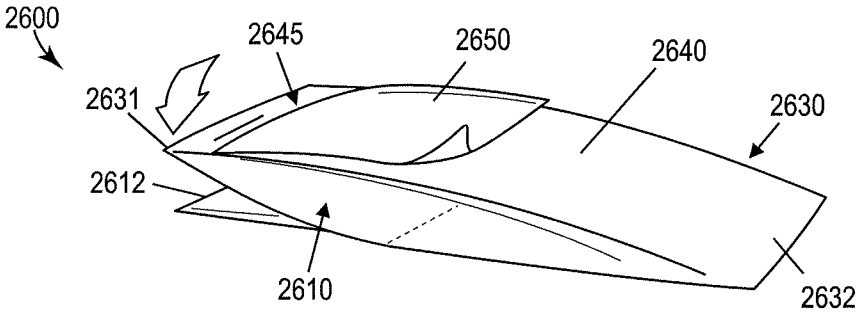
FIG. 27C is an illustration of an alternate dispenser system configuration for the patient transfer device.

FIG. 27C is an alternate illustration of patient transfer device 2600, showing dispenser system 2610 in a different configuration. In this example, cover 2612 of dispenser 2610 forms a bottom part of device housing 2630, for example opening down to load a cartridge of transfer sheets 2650 into first side 2631 of device 2600.

Figure 28A:
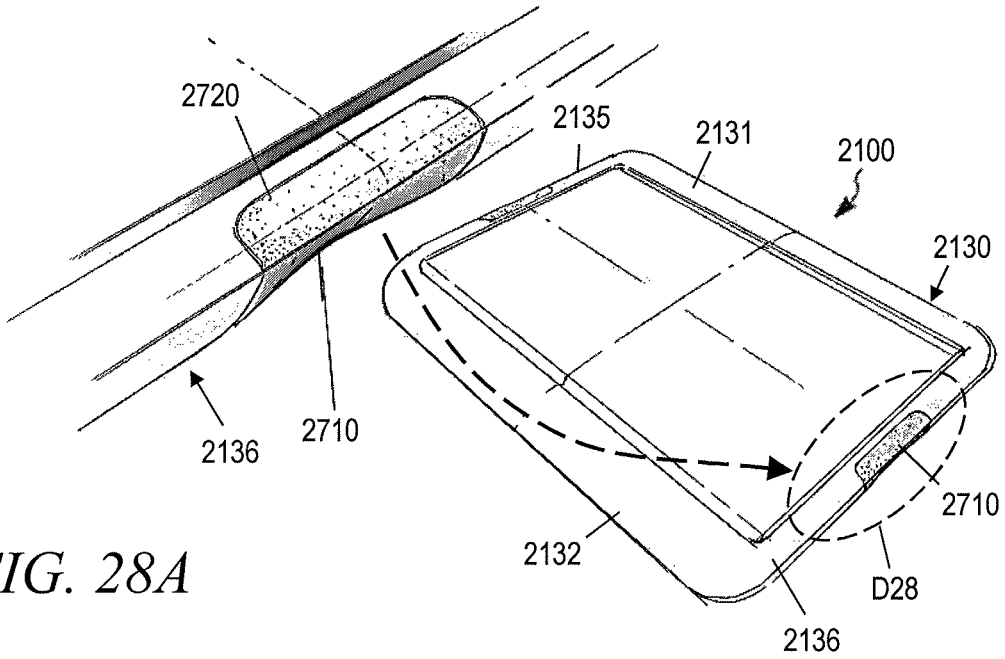
FIG. 28A is a perspective view of an ergonomic feature for the patient transfer device, according to an exemplary embodiment of the present disclosure.

FIG. 28A is a perspective view of patient transfer device 2100, illustrating the configuration of a handle or other ergonomic feature 2710. In this example, handle 2710 is formed as an indentation on one or both end caps 2135 and 2136 of device housing 2130, as shown in the lower right of FIG. 28A. Handle 2171 may include a textured surface 2720 for improved handling, for example as shown in the upper left detail of second end cap 2136.

Figure 28B:
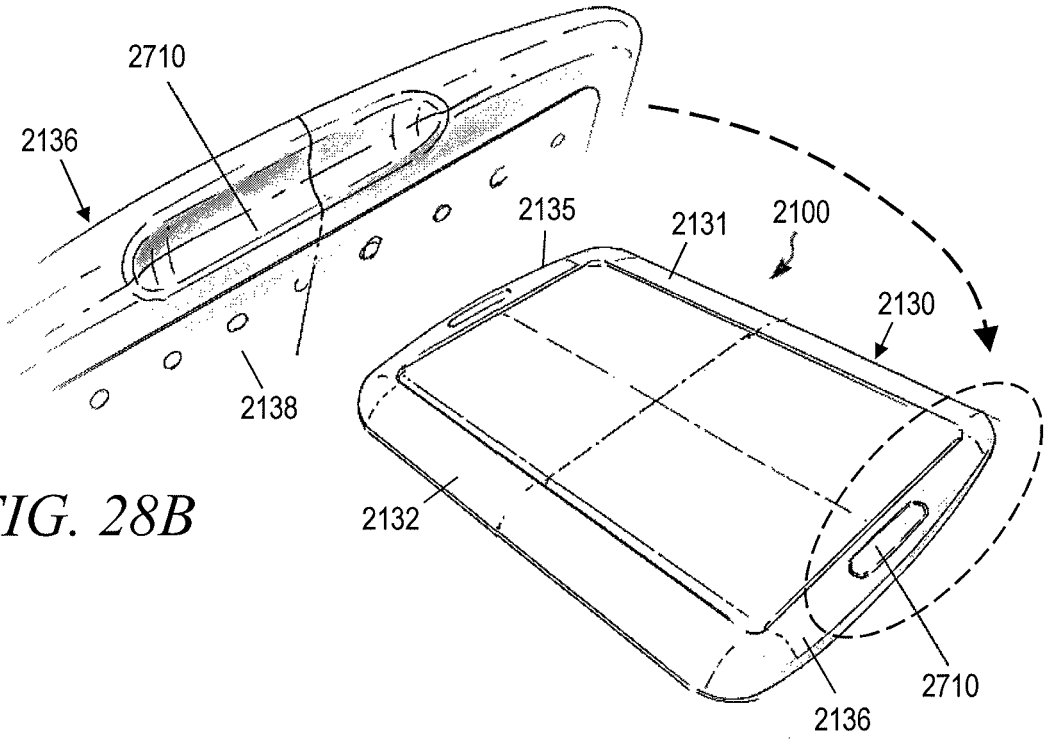
FIG. 28B is a perspective view of the ergonomic feature, in an alternate embodiment.

FIG. 28B is an alternate perspective view of ergonomic handle feature 2710, in a different embodiment. In this example, ergonomic handle 2710 is presented on the top surface of one or both end caps 2135 and 2136 of device housing 2130, as shown in the lower right of FIG. 28B. An additional indentation-type ergonomic feature 2710 may also be provided adjacent bottom housing 2138, for example as shown in the upper left detail of second end cap 2136.

Alternatively, or in addition, handles or ergonomic features 2710 may also be provided on one or both of sides 2131 and 2132 of housing 2130. Device 2100 may also have alternate configurations, for example as described above for patient transfer devices 300, 1800 and 2600.

Tabbed Sheet Designs

Figure 29A:
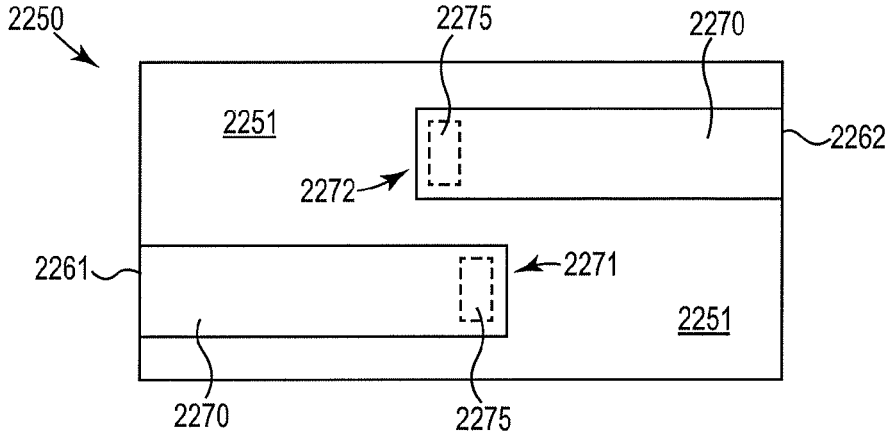
FIG. 29A is a bottom view of a tabbed transfer sheet for a patient transfer device.

FIG. 29A is a bottom view of a tabbed transfer or "wrap" sheet 2250, for example a tabbed embodiment of a transfer sheet 700, 1900 or 1950, as configured for use with a patient transfer device 300, 1800 or 2600. Alternatively, a tabbed sheet 2250 may be independently provided and utilized for wrapping about a patient, with or without a transfer device or patient transfer operation.

In the particular configuration of FIG. 29A, tabbed sheet or wrap 2250 includes two tabs, bands or straps 2270, extending from opposite edges 2261 and 2262 of sheet 2250 and across bottom or base layer 2251. Alternatively, a single tab or band 2270 may be provided along either edge 2261 or 2262, or one or more bands 2270 may be provided at both edges 2261 and 2262.

Suitable materials for tabs, bands or straps 2270 include, but are not limited to, the materials used for other components of sheet 700, 1900 or 1950, as described herein. For example, tabs or bands 2270 may be formed as an integral or connected extension of bottom layer 2251, using the same or similar materials as any of bottom layer 2251, middle layer 2252, and/or top layer 2253. Strong reinforcing materials may also be used in tabs or bands 2270, for example a spun polymer or woven fiber material, as described herein.

Free ends 2271 and 2272 of tabs or bands 2270 may be removably attached to sheet 2250 prior to deployment. For example, an adhesive or similar material 2275 may be provided to detachably adhere free ends 2271 and 2272 of each tab or band 2270 to the bottom surface (or base layer) 2251 of sheet 2250. The opposite end of each tab or band 2270 may be permanently or integrally attached or fixed to sheet 2250, for example along one or both of opposite ends or edges 2261 and 2262, as shown in FIG. 29A, or within the border region as described above (see, e.g., FIG. 20A).

Figure 29B:
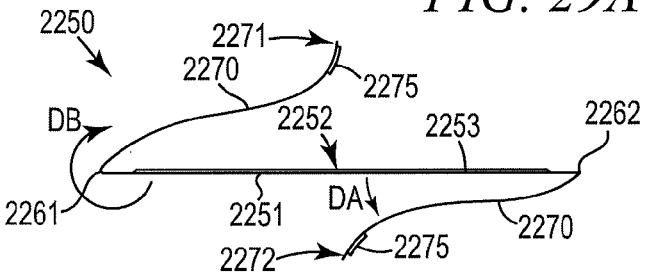
FIG. 29B is an end view of the tabbed sheet, showing the tab or band configuration.

FIG. 29B is an end view of tabbed sheet 2250, showing the configuration of tabs or bands 2270. As shown in FIG. 29B, free ends 2271 and 2272 of each tab or band 2270 may be removed from bottom layer 2251 of sheet 2250 for deployment (see arrow DA), for example before, during or after a patient transfer. In the deployed configuration, free ends 2271 and 2272 can be manipulated from a position below or opposing bottom surface 2251 of sheet 2250, to a position over or opposing top surface 2253 (arrow DB). Additional adhesive 2275 may be applied to the top or bottom surfaces of free ends 2271 and 2272 of each tab or band 2270, e.g., for securing tabbed sheet 2250 about a patient, as described below.

Figure 29C:
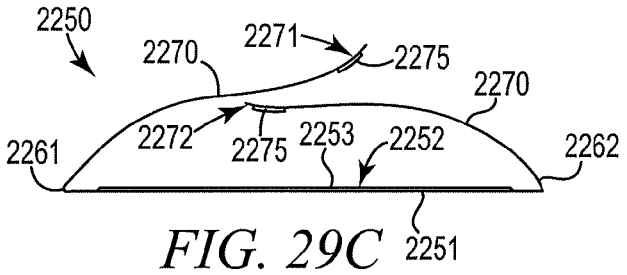
FIG. 29C is an end view of the tabbed sheet, illustrating the tab deployment.

FIG. 29C is an end view of tabbed sheet 2250, with bands 2270 deployed. As shown in FIG. 29C, free ends 2271 and 2272 are positioned above top layer 2251 of sheet 2250. The opposite ends of tabs or bands 2270 remain fixed to sheet 2250, for example along fixed ends or edges 2261 and 2262 (that is, along the opposite edges of sheet 2250), opposite free ends 2271 and 2272.

Figure 29D:
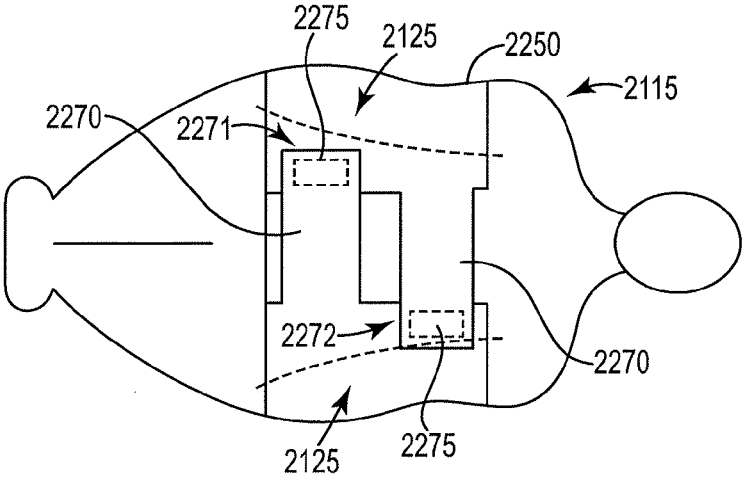
FIG. 29D is a top view of the tabbed sheet, as deployed about a patient.

FIG. 29D is a top view of tabbed sheet 2250, as deployed about a patient or other body 2115. As shown in FIG. 29D, sheet 2250 is wrapped about the torso of patient 2115, with tabs or bands 2270 attached to opposite sides of sheet 2250 with adhesive 2275. For example, tabs or bands 2270 may be attached to the bottom (outside) layer of sheet 2250, or the top (inside) layer facing patient 2115. In either configuration, sheet 2250 is deployed to hold arms 2125 (and/or other limbs) of patient 2115 in place, in order to prevent or reduce motion, injury and discomfort during the patient transfer process, and in later recovery.

One relatively common post-operative and recovery complication addressed by a tabbed sheet 2250 is the occurrence of corneal abrasion. Recovering from anesthesia, unconscious or semi-conscious patients may manipulate their arms to "itch" or "scratch" their eyes, for example in a post-anesthesia care unit (PACU) or other recovery environment. Sometimes, this may result in corneal abrasion, or other injury or complication.

Corneal abrasions are among the more frequent ocular complications following general anesthesia, and can present a painful burden to recovering (e.g., postoperative) patients 2115. Corneal abrasions can occur during or in recovery from general anesthesia procedures, monitored anesthesia care, and regional anesthesia applications.

Typically, post-operative eye injuries are attributable to patients 2115 rubbing their eyes, or due to pulse oximeters or bed linens. The etiology and pathophysiology of corneal abrasions in the perioperative period are well defined, and risk factors have been identified in trials.

The risk factors include, for example, patient position (e.g., prone or lateral) and increased procedure length. In particular, longer procedures may pose a greater risk to patients, and practitioners may consider prophylactic lubrication in such cases, particularly when performed in the prone or lateral position.

Depending upon the risk level, tabs 2170 or similar features may be deemed medically advisable or medically necessary, or provided as a standard physician's order. Thus, tabbed or banded sheets 2250 may be utilized as gentle restraints or positioners to prevent or reduce the risk of corneal abrasion and other post-operative injuries, and to reduce the associated rates of re-admission due to such complications.

In the tabbed or banded configurations described herein, extended tabs 2770 can be manipulated to strap, secure or gently "bind" arms 2225 (dashed lines) of patient 2115 to his or her or sides while under the influence of anesthesia, or otherwise in an altered state of consciousness. For example, tabs or bands 2270 may removably adhere to sheet 2250 with glue or other adhesive material 2275 covered with a removable paper or tab, as described above. Alternatively, tabs or bands 2270 may be adhered to one another, or tied together or otherwise mechanically fastened, for example utilizing a string, textile or other woven material extending from or manufactured to together with the material of sheet 2250, as described above.

Generally, applications of a tabbed "wrap" sheet 2250 may be regarded as preventive measure, with sheet 2250 configured to relatively gently hold arms (or other limbs) 2125 of patient 2115 in place during the transfer and recovery process, rather than an outright restraint, as known in the art. Alternatively, the material of extended tabs or bands 2270 may be selected to provide relatively more or relatively less tensile and holding strength and restraint capability, depending upon application. The material characteristics of adhesive 2275 may also be appropriately selected, depending upon the desired (e.g., removable or permanent) bonding strength.

Figure 30A:
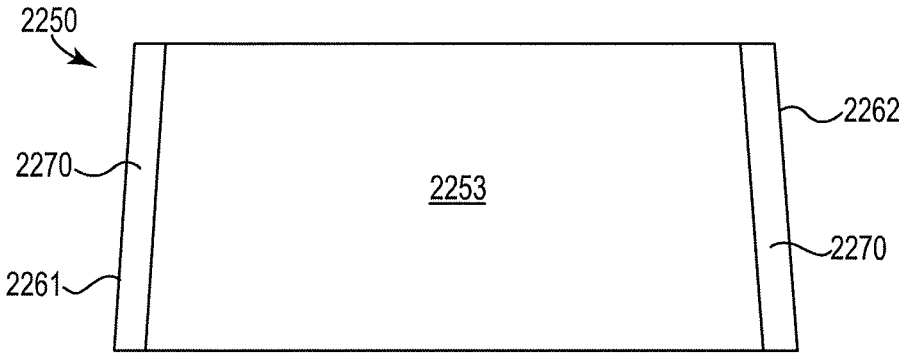
FIG. 30A is a plan view of the tabbed sheet, in an alternate configuration.

FIG. 30A is a plan view of the tabbed transfer or wrap sheet, in an alternate configuration. As shown in FIG. 30A, tabs or bands 2270 may also be provided on top surface 2253 of sheet 2250, or on bottom surface 2251, as described above. Tabs or bands 2270 may also extends along opposite ends or edges 2261 and 2262 of sheet 2250, attached at either end (that is, attached at either the top or bottom of FIG. 30A, and free at the opposite end).

Figure 30B:
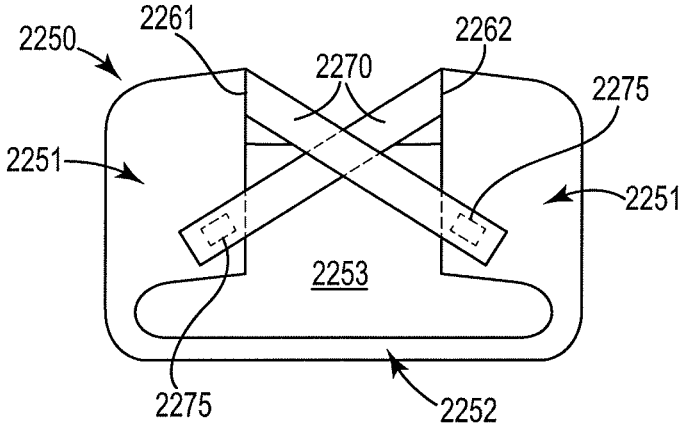
FIG. 30B is a top view of the tabbed sheet, with the tabs or bands deployed.

FIG. 30B is a top view of tabbed sheet 2250, with tabs or bands 2270 deployed. In FIG. 30B, tabs, bands or straps 2270 extend from the facing edges 2261 and 2262 of sheet 2250, and are attached at the opposite edges or ends 2262 and 2261, respectively. Tabs or bands 2270 may be adhered to the bottom (outer) or top (inner) surface of sheet 2250 using adhesive 2275, for example in a crossed or diagonal configuration as shown.

Figure 30C:
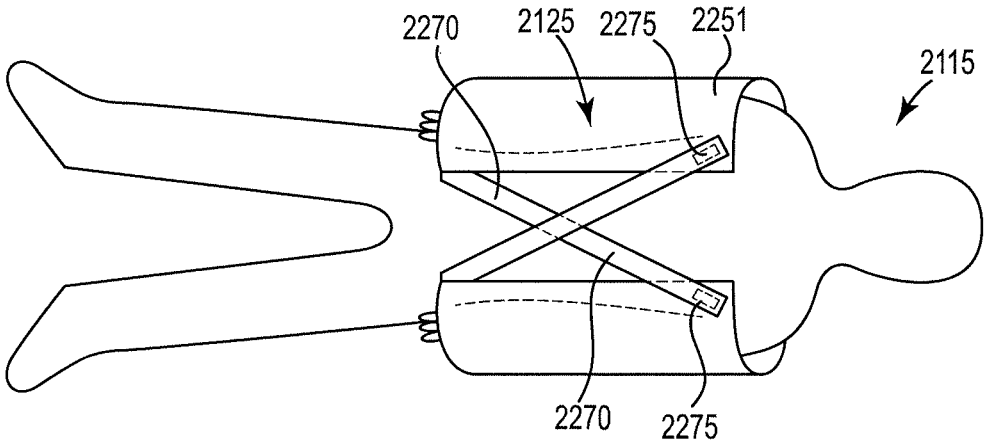
FIG. 30C is a top view of the tabbed sheet, wrapped about a patient with the tabs or bands attached.

FIG. 30C is a top view of tabbed sheet 2250, wrapped about patient 2115 with tabs or bands 2270 attached to opposing ends or edges of the bottom layer or bottom surface 2251. In this configuration, tabs or bands 2170 are deployed to retain arms 2125 in position during patient transfer and recovery, for example to reduce the risk of postoperative injury or other complication, as described above. In particular, a tabbed "wrap" sheet 2250 may be deployed about patient 2115 as shown in FIG. 30C when there is substantial a risk of corneal abrasion or other complication due to unconscious or semi-conscious manipulation of limbs 2125 by patient 2115.

While this invention has been described with reference to exemplary embodiments, it will be understood by those skilled in the art that various changes can be made and different equivalents may be substituted for particular elements thereof, without departing from the spirit and scope of the invention. The invention is thus not limited to the particular examples that are disclosed, but can also be adapted to different problems and situations, and applied with different materials and techniques, without departing from the essential scope of embodiments encompassed by the appended claims.

The invention claimed is:

1. A single-use transfer sheet for a patient transfer device comprising a continuous belt disposed about a bridge spaced between two sides of a housing, the transfer sheet comprising:

a structural base layer;

an absorbent layer disposed on the base layer;

a permeable layer disposed on the absorbent layer, wherein the absorbent layer is disposed between the base layer and the permeable layer;

an adhesive area on a bottom surface of the base layer, opposite the absorbent layer and the permeable layer; and a tab extending over the adhesive area, the tab configured for removal therefrom and the adhesive area configured for attachment of the base layer to the continuous belt of the patient transfer device, wherein the transfer sheet is configured to be pulled by a caregiver to transfer a patient from a first surface to a second surface using the device, the transfer sheet having a minimum pull strength sufficient to withstand a pull force of at least 150 N and a yield limit selected for the transfer sheet to yield when exceeding a pull force limit of 880 N, wherein the yield limit is selected for the transfer sheet to act as a mechanical fuse to provide a failure warning when exceeding a safe pull force limit.

2. The single-use transfer sheet of claim 1, wherein the adhesive area is adapted for removable attachment of the transfer sheet to the continuous belt of the patient transfer device.

3. The single-use transfer sheet of claim 1, wherein the yield limit is selected for the transfer sheet to yield when exceeding a safe pull force limit of 340 N for a single caregiver.

4. The single-use transfer sheet of claim 1, wherein the base layer, the absorbent layer and the permeable layer are bonded together to provide a tensile strength of at least 180 N to allow for the pull force to be applied to an edge of the transfer sheet.

5. The single-use transfer sheet of claim 4, wherein the base layer comprise a spun or woven polyamide, aramid, para-aramid or polyethylene fiber material.

6. The single-use transfer sheet of claim 5, wherein the bonded layers of the transfer sheet provide a bursting strength of at least 600 kPa and a tear resistance of at least 25 N.

7. The single-use transfer sheet of claim 6, wherein the base layer comprises a flash-spun high-density polyethylene fiber material.

8. The single-use transfer sheet of claim 6, wherein the base layer comprises a silicone impregnated material.

9. The single-use transfer sheet of claim 1, wherein the sheet has handholds at one edge.

10. The single-use transfer sheet of claim 1, further comprising a border region extending along a perimeter thereof, wherein the base layer is bonded to the permeable layer in the border region, absent the absorbent layer therebetween.

11. The single-user transfer sheet of claim 1, wherein the adhesive is attached at separate areas adjacent opposite ends of the transfer sheet on the bottom surface of the base layer.

12. The single-use transfer sheet of claim 1, further comprising tabs extending from opposing ends of the transfer sheet, the tabs deployable to extend across a patient body.

13. The single-use transfer sheet of claim 12, wherein the tabs each comprise adhesive on a free end thereof, the adhesive configured to adhere the free end of each tab to a major surface of the transfer sheet.

14. The single-use transfer sheet of claim 13, wherein the tabs are configured to wrap the sheet or the tabs about the patient body to secure limbs of the patient in position.

15. The single-use transfer sheet of claim 1, further comprising an antimicrobial material in at least one layer.

16. The single-use transfer sheet of claim 15, wherein the antimicrobial material comprises silver nitrate.

17. The single-use transfer sheet of claim 1, wherein the layers are sterile.

18. The single-use transfer sheet of claim 1, further comprising additional absorbent material provided in a selected region of the absorbent layer.

19. The single-user transfer sheet of claim 18, wherein the transfer sheet has an absorptive capacity of at least 1.5 liter (or about 50 ounces).

20. A method of loading the single-use transfer sheet of claim 1 onto the patient transfer device, the method comprising:

removing a tab extending over the area of the adhesive;

attaching the base layer to the continuous belt of the patient transfer device with the adhesive; and translating the continuous belt to load at least a portion of the single-use sheet into the housing, wherein the single-use sheet extends from the housing and over a top surface of the bridge on the continuous belt.

21. A method of using the single-use transfer sheet of claim 1, further comprising:

spanning a gap between the first and second surfaces with the device; and transferring the patient between the first surface and the second surface, wherein the patient is supported on the bridge in conveying relationship with the single-use transfer sheet attached to the continuous belt.

22. The method of claim 21, further comprising isolating the single-use transfer sheet from contact with the first surface in transferring the body across the support bridge and onto the second surface.

23. The method of claim 22, further comprising leaving the single-use transfer sheet beneath the patient on the second surface, wherein the single-use transfer sheet and patient transfer device are configured to reduce a probability of cross-contamination from the first surface to the second surface.

24. The method of claim 21, further comprising securing the single-use transfer sheet about the patient, wherein the single-use transfer sheet maintains a limb of the patient in position.

25. The method of claim 24, further comprising deploying tabs extending from opposing ends of the single-use transfer sheet, the tabs configured to secure the single-use transfer sheet about the patient such that the limb of the patient is restrained.

26. The method of claim 25, wherein securing the single-use transfer sheet about the patient further comprises adhering a free end of each of the tabs to a surface of the single-use transfer sheet.

27. The method of claim 25, wherein securing the single-use transfer sheet about the patient comprises attaching free ends of each of the tabs together.

28. The single-use transfer sheet of claim 1, wherein the yield limit is selected for the transfer sheet to yield when exceeding a pull force limit of 660 N for two or more caregivers working together in coordinated fashion.

29. The single-use transfer sheet of claim 28, wherein the yield limit is selected for the transfer sheet to yield when exceeding a pull force limit of 450 N.

30. A transfer sheet configured for transferring a patient on a transfer device comprising a bridge disposed between two sides of a housing, the transfer sheet comprising:

a structural base layer;

an absorbent layer disposed on the base layer; and a permeable layer disposed on the absorbent layer, wherein the absorbent layer is disposed between the base layer and the permeable layer;

wherein the transfer sheet is configured to be pulled by a caregiver to transfer the patient from a first surface at a first side of the device and over the bridge to a second surface at the second side of the device, the transfer sheet having a minimum pull strength sufficient to withstand a pull force of at least 150 N and a yield limit selected for the transfer sheet to yield when exceeding a pull force limit of 880 N, wherein the yield limit is selected for the transfer sheet to act as a mechanical fuse to provide a failure warning when exceeding a safe pull force limit.

31. The transfer sheet of claim 30, wherein the yield limit is selected for the transfer sheet to yield when exceeding a pull force limit of 660 N for two or more caregivers working together in coordinated fashion.

32. The transfer sheet of claim 31, wherein the yield limit is selected for the transfer sheet to yield when exceeding a pull force limit of 450 N.

33. The transfer sheet of claim 32, wherein the yield limit is selected to provide a failure warning when exceeding a safe pull force limit of 340 N for a single caregiver.

34. The transfer sheet of claim 32, wherein the yield limit is selected for the transfer sheet to yield when exceeding a pull force limit of 340 N for a single caregiver.

35. The transfer sheet of claim 30, wherein the base layer, the absorbent layer and the permeable layer are bonded together to provide a bursting strength of at least 600 kPa for the transfer sheet.

* * * * *